US008494863B2

(12) United States Patent
Biswas et al.

(10) Patent No.: US 8,494,863 B2
(45) Date of Patent: Jul. 23, 2013

(54) AUDIO ENCODER AND DECODER WITH LONG TERM PREDICTION

(75) Inventors: Arijit Biswas, Nuremberg (DE); Heiko Purnhagen, Sundbyberg (SE); Kristofer Kjoerling, Solna (SE); Barbara Resch, Solna (SE); Lars Villemoes, Järfälla (SE); Per Hedelin, Göteborg (SE)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 393 days.

(21) Appl. No.: 12/811,419

(22) PCT Filed: Dec. 30, 2008

(86) PCT No.: PCT/EP2008/011145

§ 371 (c)(1),
(2), (4) Date: Jul. 1, 2010

(87) PCT Pub. No.: WO2009/086919

PCT Pub. Date: Jul. 16, 2009

(65) Prior Publication Data

US 2010/0286990 A1 Nov. 11, 2010

Related U.S. Application Data

(60) Provisional application No. 61/055,975, filed on May 24, 2008.

(30) Foreign Application Priority Data

Jan. 4, 2008 (SE) ..... 0800032
May 24, 2008 (EP) ..... 08009531

(51) Int. Cl.

| | |
|---|---|
| ***G10I 19/14*** | (2006.01) |
| ***G10L 19/06*** | (2006.01) |
| ***G10L 19/00*** | (2006.01) |
| ***G10L 19/12*** | (2006.01) |
| ***G10L 21/04*** | (2006.01) |

(52) U.S. Cl.
USPC ..... 704/500; 704/205; 704/207; 704/219; 704/220; 704/222; 704/223; 704/501; 704/502; 704/503; 704/504

(58) Field of Classification Search
USPC ..... 704/205, 207, 219, 220, 222, 223, 704/500–504
See application file for complete search history.

(56) References Cited

U.S. PATENT DOCUMENTS 5,553,191 A * 9/1996 Minde ..... 704/221
5,717,825 A * 2/1998 Lamblin ..... 704/223

(Continued)

FOREIGN PATENT DOCUMENTS

EP 0673014 9/1995
EP 1262956 12/2002

(Continued)

OTHER PUBLICATIONS

Ordentlich, E.; Shoham, Y.; , "Low-delay code-excited linear-predictive coding of wideband speech at 32 kbps," Acoustics, Speech, and Signal Processing, 1991. ICASSP-91., 1991 International Conference on , vol., No., pp. 9-12 vol. 1, Apr. 14-17, 1991.*

(Continued)

*Primary Examiner* — Paras D Shah

(57) ABSTRACT

The present invention teaches a new audio coding system that can code both general audio and speech signals well at low bit rates. A proposed audio coding system comprises a linear prediction unit for filtering an input signal based on an adaptive filter; a transformation unit for transforming a frame of the filtered input signal into a transform domain; a quantization unit for quantizing a transform domain signal; a long term prediction unit for determining an estimation of the frame of the filtered input signal based on a reconstruction of a previous segment of the filtered input signal; and a transform domain signal combination unit for combining, in the transform domain, the long term prediction estimation and the transformed input signal to generate the transform domain signal.

31 Claims, 25 Drawing Sheets

U.S. PATENT DOCUMENTS

| | | | | |
|---|---|---|---|---|
| 6,012,025 | A | 1/2000 | Yin | |
| 6,243,673 | B1 * | 6/2001 | Ohno | 704/207 |
| 6,389,006 | B1 * | 5/2002 | Bialik | 370/352 |
| 6,611,800 | B1 * | 8/2003 | Nishiguchi et al. | 704/221 |
| 6,879,955 | B2 * | 4/2005 | Rao | 704/241 |
| 7,457,743 | B2 * | 11/2008 | Ojanpera | 704/206 |
| 7,460,993 | B2 * | 12/2008 | Chen et al. | 704/200.1 |
| 7,610,195 | B2 * | 10/2009 | Ojanpera | 704/200.1 |
| 8,032,362 | B2 * | 10/2011 | Choo et al. | 704/219 |
| 2002/0010577 | A1 | 1/2002 | Matsumoto | |
| 2002/0040299 | A1 | 4/2002 | Makino | |
| 2003/0215013 | A1 * | 11/2003 | Budnikov | 375/240.16 |
| 2007/0100607 | A1 * | 5/2007 | Villemoes | 704/207 |
| 2007/0106502 | A1 * | 5/2007 | Kim et al. | 704/207 |
| 2007/0282599 | A1 * | 12/2007 | Choo et al. | 704/205 |
| 2008/0270124 | A1 * | 10/2008 | Son et al. | 704/205 |
| 2010/0138218 | A1 * | 6/2010 | Geiger | 704/205 |

FOREIGN PATENT DOCUMENTS

| | | |
|---|---|---|
| EP | 1278184 | 1/2003 |
| JP | 9-127998 | 5/1997 |
| JP | 2001-142499 | 5/2001 |
| JP | 2003-044097 | 2/2003 |
| JP | 2004-246038 | 9/2004 |
| JP | 2007-286200 | 11/2007 |
| KR | 2002-0077959 | 10/2002 |
| KR | 10-2006-0121973 | 11/2006 |
| RU | 2144261 | 1/2000 |
| RU | 98103512 | 1/2000 |
| WO | 95/28699 A | 10/1995 |
| WO | 02/41302 A | 5/2002 |
| WO | 2006008817 | 1/2006 |

OTHER PUBLICATIONS

Ramprashad, S.A.; , "The multimode transform predictive coding paradigm," Speech and Audio Processing, IEEE Transactions on , vol. 11, No. 2, pp. 117-129, Mar. 2003.*

Friedrich, Tobias; Schuller, Gerald; , "Spectral Band Replication Tool for Very Low Delay Audio Coding Applications," Applications of Signal Processing to Audio and Acoustics, 2007 IEEE Workshop on , vol., No., pp. 199-202, Oct. 21-24, 2007.*

Oger, M., et al., "Transform Audio Coding with Model-Based Bit Allocation" Proceedings of ICASSP 2007, vol. 4, Apr. 15-20, 2007, pp. 545-548.

Juin-Hwey Chen, "A candidate coder for the ITU-T's new wideband speech coding standard", Acoustics, Speech, and Signal Processing, 1997 IEEE International Conference on Munich , Germany, Apr. 21-24, 1997, Los Alamitos, CA, US, IEEE, Comput. Soc, US, vol. 2, Apr. 21, 1997, pp. 1359-1362.

Juha Ojanpera, et al, "Long Term Predictor for Transform Domain Perceptual Audio Coding", AES convention 107, No. 5036, Sep. 24, 1999-Sep. 27, 1999, pp. 1-10.

Omar Niamut et al., "RD Optimal Time Segmentations for the Time-Varying MDCT", Proceedings of the European Signal Processing Conference, Sep. 6, 2004, pp. 1649-1652.

* cited by examiner

AUDIO ENCODER AND DECODER WITH LONG TERM PREDICTION

TECHNICAL FIELD

The present invention relates to coding of audio signals, and in particular to the coding of any audio signal not limited to either speech, music or a combination thereof.

BACKGROUND OF THE INVENTION

In prior art there are speech coders specifically designed to code speech signals by basing the coding upon a source model of the signal, i.e. the human vocal system. These coders cannot handle arbitrary audio signals, such as music, or any other non-speech signal. Additionally, there are in prior art music-coders, commonly referred to as audio coders that base their coding on assumptions on the human auditory system, and not on the source model of the signal. These coders can handle arbitrary signals very well, albeit at low bit rates for speech signals, the dedicated speech coder gives a superior audio quality. Hence, no general coding structure exists so far for coding of arbitrary audio signals that performs as well as a speech coder for speech and as well as a music coder for music, when operated at low bit rates.

Thus, there is a need for an enhanced audio encoder and decoder with improved audio quality and/or reduced bit rates.

SUMMARY OF THE INVENTION

The present invention relates to efficiently coding arbitrary audio signals at a quality level equal or better than that of a system specifically tailored to a specific signal.

The present invention is directed at audio codec algorithms that contain both a linear prediction coding (LPC) and a transform coder part operating on a LPC processed signal.

The present invention further relates to efficiently making use of a bit reservoir in an audio encoder with a variable frame size.

The present invention further relates to the operation of long term prediction in combination with a transform coder having a variable frame size.

The present invention further relates to an encoder for encoding audio signals and generating a bitstream, and a decoder for decoding the bitstream and generating a reconstructed audio signal that is perceptually indistinguishable from the input audio signal.

The present invention provides an audio coding system that is based on a transform coder and includes fundamental prediction and shaping modules from a speech coder. The inventive system comprises a linear prediction unit for filtering an input signal based on an adaptive filter; a transformation unit for transforming a frame of the filtered input signal into a transform domain; a quantization unit for quantizing a transform domain signal; a long term prediction unit for estimating the frame of the filtered input signal based on a reconstruction of a previous segment of the filtered input signal; and a transform domain signal combination unit for combining, in the transform domain, the long term prediction estimation and the transformed input signal to generate the transform domain signal that is input to the quantization unit.

The audio coding system may further comprise an inverse quantization and inverse transformation unit for generating a time domain reconstruction of the frame of the filtered input signal. Furthermore, a long term prediction buffer for storing time domain reconstructions of previous frames of the filtered input signal may be provided. These units may be arranged in a feedback loop from the quantization unit to a long term prediction extraction unit that searches, in the long term prediction buffer, for the reconstructed segment that best matches the present frame of the filtered input signal. In addition, a long term prediction gain estimation unit may be provided that adjusts the gain of the selected segment from the long term prediction buffer so that it best matches the present frame. Preferably, the long term prediction estimation is subtracted from the transformed input signal in the transform domain. Therefore, a second transform unit for transforming the selected segment into the transform domain may be provided. The long term prediction loop may further include adding the long term prediction estimation in the transform domain to the feedback signal after inverse quantization and before inverse transformation into the time-domain. Thus, a backward adaptive long term prediction scheme may be used that predicts, in the transform domain, the present frame of the filtered input signal based on previous frames. In order to be more efficient, the long term prediction scheme may be further adapted in different ways, as set out below for some examples.

The adaptive filter for filtering the input signal is preferably based on a Linear Prediction Coding (LPC) analysis including a LPC filter producing a whitened input signal. LPC parameters for the present frame of input data may be determined by algorithms known in the art. A LPC parameter estimation unit may calculate, for the frame of input data, any suitable LPC parameter representation such as polynomials, transfer functions, reflection coefficients, line spectral frequencies, etc. The particular type of LPC parameter representation that is used for coding or other processing depends on the respective requirements. As is known to the skilled person, some representations are more suited for certain operations than others and are therefore preferred for carrying out these operations. The linear prediction unit may operate on a first frame length that is fixed, e.g. 20 msec. The linear prediction filtering may further operate on a warped frequency axis to selectively emphasize certain frequency ranges, such as low frequencies, over other frequencies.

The transformation applied to the frame of the filtered input signal is preferably a Modified Discrete Cosine Transform (MDCT) operating on a variable second frame length. The audio coding system may comprise a window sequence control unit determining, for a block of the input signal, the frame lengths for overlapping MDCT windows by minimizing a coding cost function, preferably a simplistic perceptual entropy, for the entire input signal block including several frames. Thus, an optimal segmentation of the input signal block into MDCT windows having respective second frame lengths is derived. In consequence, a transform domain coding structure is proposed, including speech coder elements, with an adaptive length MDCT frame as only basic unit for all processing except the LPC. As the MDCT frame lengths can take on many different values, an optimal sequence can be found and abrupt frame size changes can be avoided, as are common in prior art where only a small window size and a large window size is applied. In addition, transitional transform windows having sharp edges, as used in some prior art approaches for the transition between small and large window sizes, are not necessary.

Preferably, consecutive MDCT window lengths change at most by a factor of two (2) and/or the MDCT window lengths are dyadic values. More particular, the MDCT window lengths may be dyadic partitions of the input signal block. The MDCT window sequence is therefore limited to predetermined sequences which are easy to encode with a small number of bits. In addition, the window sequence has smooth transitions of frame sizes, thereby excluding abrupt frame size changes.

A window sequence encoder for jointly encoding MDCT window lengths and window shapes in a window sequence may be provided. A joint encoding may remove redundancy and require fewer bits. The window sequence encoder may consider window size constraints when encoding the window lengths and shapes of a window sequence so as to omit unnecessary information (bits) that can be reconstructed in the decoder.

The window sequence control unit may be further configured to consider long term prediction estimations, generated by the long term prediction unit, for window length candidates when searching for the sequence of MDCT window lengths that minimizes the coding cost function for the input signal block. In this embodiment, the long term prediction loop is closed when determining the MDCT window lengths which results in an improved sequence of MDCT windows applied for encoding.

Further, a time warp unit for uniformly aligning a pitch component in the frame of the filtered signal by resampling the filtered input signal according to a time-warp curve may be provided. The time-warp curve is preferably determined so as to uniformly align the pitch components in the frame. Thus, the transformation unit and/or the long term prediction unit may operate on time-warped signals having constant pitch, which improves the accuracy of the signal analysis.

The audio coding system may further comprise a LPC encoder for recursively coding, at a variable rate, line spectral frequencies or other appropriate LPC parameter representations generated by the linear prediction unit for storage and/or transmission to a decoder. According to an embodiment, a linear prediction interpolation unit is provided to interpolate linear prediction parameters generated on a rate corresponding to the first frame length so as to match the variable frame lengths of the transform domain signal.

According to an aspect of the invention, the audio coding system may comprise a perceptual modeling unit that modifies a characteristic of the adaptive filter by chirping and/or tilting a LPC polynomial generated by the linear prediction unit for a LPC frame. The perceptual model received by the modification of the adaptive filter characteristics may be used for many purposes in the system. For instance, it may be applied as perceptual weighting function in quantization or long term prediction.

Another independent aspect of the invention relates to extending the bandwidth of an audio encoder by providing separate means for encoding a highband component of the input signal. According to an embodiment, a highband encoder for encoding the highband component of the input signal is provided. Preferably, the highband encoder is a spectral band replication (SBR) encoder. The separate coding of the highband with the highband encoder allows different quantization steps, used in the quantization unit when quantizing the transform domain signal, for encoding components of the transform domain signal belonging to the highband as compared to components belonging to a lowband of the input signal. More particularly, the quantizer may apply a coarser quantization of the highband signal component that is also encoded by the highband encoder which reduces bit rate.

According to another embodiment, a frequency splitting unit for splitting the input signal into the lowband component and the highband component is provided. The highband component is then encoded by the highband encoder, and the lowband component is input to the linear prediction unit and encoded by the above proposed transform encoder. Preferably, the frequency splitting unit comprises a quadrature mirror filter bank and a quadrature mirror filter synthesis unit configured to downsample the input signal that is to be input to the linear prediction unit. The signal from the quadrature mirror filter bank may be input directly to the highband encoder. This is particularly useful when the highband encoder is a spectral band replication encoder that can be fed directly by the quadrature mirror filter bank signal. In addition, the combination of quadrature minor filter bank and quadrature mirror filter synthesis unit serves as premium downsampler for the lowband component.

The boundary between the lowband and the highband may be variable and the frequency splitting unit may dynamically determine the cross-over frequency between the lowband and the highband. This allows an adaptive frequency allocation, e.g. based on input signal properties and/or encoder bandwidth requirements.

According to another aspect, the audio coding system may comprise a second quadrature mirror filter synthesis unit that transfers the highband component into a low-pass signal. This downmodulated high frequency range can then be encoded by a second transform-based encoder, possibly with a lower resolution, i.e. larger quantization steps. This is particularly useful when the high frequency band is further encoded by other means as well, e.g. a spectral band replication encoder. Then, a combination of both ways to encode the high frequency band may be more efficient.

Different signal representations covering the same frequency range may be combined by a signal representation combination unit that exploits correlations in the signal representations in order to reduce the necessary bit rate. The signal representation combination unit may further generate signaling data indicating how the signal representations are combined. This signaling data may be stored or transmitted to the decoder for reconstructing the encoded audio signal from the different signal representations.

A spectral band replication unit may further be provided in the long term prediction unit for introducing energy into the high frequency components of the long term prediction estimations. This serves to improve the efficiency of the long term prediction.

According to an embodiment, a stereo signal having left and right input channels is input to a parametric stereo unit for calculating a parametric stereo representation of the stereo signal including a mono representation of the input signal. The mono representation may then be input to the LPC analysis unit and the subsequent transformation coder as proposed above. Thus, an efficient means to encode the stereo signal is obtained where essentially only the mono representation is waveform coded and the stereo effect is achieved with the low bit rate parametric stereo representation.

Further enhancements of the quality of the coded signal relate to the usage of a harmonic prediction analysis unit for predicting harmonic signal components in the frequency/MDCT-domain.

Another independent encoder specific aspect of the invention relates to bit reservoir handling for variable frame sizes. In an audio coding system that can code frames of variable length, the bit reservoir is controlled by distributing the available bits among the frames. Given a reasonable difficulty measure for the individual frames and a bit reservoir of a defined size, a certain deviation from a required constant bit rate allows for a better overall quality without a violation of the buffer requirements that are imposed by the bit reservoir size. The present invention extends the concept of using a bit reservoir to a bit reservoir control for a generalized audio codec with variable frame sizes. An audio coding system may therefore comprise a bit reservoir control unit for determining the number of bits granted to encode a frame of the filtered signal based on the length of the frame and a difficulty measure of the frame. Preferably, the bit reservoir control unit has separate control equations for different frame difficulty measures and/or different frame sizes. Difficulty measures for different frame sizes may be normalized so they can be compared more easily. In order to control the bit allocation for a variable rate encoder, the bit reservoir control unit preferably sets the lower allowed limit of the granted bit control algorithm to the average number of bits for the largest allowed frame size.

The present invention further relates to the aspect of quantizing MDCT lines in a transform encoder. This aspect is applicable independently of whether the encoder uses a LPC analysis or a long term prediction. The proposed quantization strategy is conditioned on input signal characteristics, e.g. transform frame-size. It is suggested that the quantization unit may decide, based on the frame size applied by the transformation unit, to encode the transform domain signal with a model-based quantizer or a non-model-based quantizer. Preferably, the quantization unit is configured to encode a transform domain signal for a frame with a frame size smaller than a threshold value by means of a model-based entropy constrained quantization. The model-based quantization may be conditioned on assorted parameters. Large frames may be quantized, e.g., by a scalar quantizer with e.g. Huffman based entropy coding, as is used in e.g. the AAC codec.

The switching between different quantization methods of the MDCT lines is another aspect of a preferred embodiment of the invention. By employing different quantization strategies for different transform sizes, the codec can do all the quantization and coding in the MDCT-domain without having the need to have a specific time domain speech coder running in parallel or serial to the transform domain codec. The present invention teaches that for speech like signals, where there is an LTP gain, the signal is preferably coded using a short transform and a model-based quantizer. The model-based quantizer is particularly suited for the short transform, and gives, as will be outlined later, the advantages of a time-domain speech specific vector quantizer (VQ), while still being operated in the MDCT-domain, and without any requirements that the input signal is a speech signal. In other words, when the model-based quantizer is used for the short transform segments in combination with the LTP, the efficiency of the dedicated time-domain speech coder VQ is retained without loss of generality and without leaving the MDCT-domain.

In addition for more stationary music signals, it is preferred to use a transform of relatively large size as is commonly used in audio codecs, and a quantization scheme that can take advantage of sparse spectral lines discriminated by the large transform. Therefore, the present invention teaches to use this kind of quantization scheme for long transforms.

Thus, the switching of quantization strategy as a function of frame size enables the codec to retain both the properties of a dedicated speech codec, and the properties of a dedicated audio codec, simply by choice of transform size. This avoids all the problems in prior art systems that strive to handle speech and audio signals equally well at low rates, since these systems inevitably run into the problems and difficulties of efficiently combining time-domain coding (the speech coder) with frequency domain coding (the audio coder).

According to another aspect of the invention, the quantization uses adaptive step sizes. Preferably, the quantization step size(s) for components of the transform domain signal is/are adapted based on linear prediction and/or long term prediction parameters. The quantization step size(s) may further be configured to be frequency depending. In embodiments of the invention, the quantization step size is determined based on at least one of: the polynomial of the adaptive filter, a coding rate control parameter, a long term prediction gain value, and an input signal variance.

Another aspect of the invention relates to long term prediction (LTP), in particular to long term prediction in the MDCT-domain, MDCT frame adapted LTP and MDCT weighted LTP search. These aspects are applicable irrespective whether a LPC analysis is present upstream of the transform coder.

According to an embodiment, the long term prediction unit comprises a long term prediction extractor for determining a lag value specifying the reconstructed segment of the filtered signal that best fits the current frame of the filtered signal. A long term prediction gain estimator may estimate a gain value applied to the signal of the selected segment of the filtered signal. Preferably, the lag value and the gain value are determined so as to minimize a distortion criterion relating to the difference, in a perceptual domain, of the long term prediction estimation to the transformed input signal. The distortion criterion may relate to the difference of the long term prediction estimation to the transformed input signal in a perceptual domain. Preferably, the distortion criterion is minimized by searching the lag value and the gain value in the perceptual domain. A modified linear prediction polynomial may be applied as MDCT-domain equalization gain curve when minimizing the distortion criterion.

The long term prediction unit may comprise a transformation unit for transforming the reconstructed signal of segments from the LTP buffer into the transform domain. For an efficient implementation of a MDCT transformation, the transformation is preferably a type-IV Discrete-Cosine Transformation.

Virtual vectors may be used to generate an extended segment of the reconstructed signal when a lag value is smaller than the MDCT frame length. The virtual vectors are preferably generated by an iterative fold-in fold-out procedure to refine the generated segment of the reconstructed signal. Thus, not yet existing segments of the reconstructed signal are generated during the lag search procedure of the long term prediction.

The reconstructed signal in the long term prediction buffer may be resampled based on a time-warp curve when the transformation unit is operating on time-warped signals. This allows a time-warped LPT extraction matching a time-warped MDCT.

According to an embodiment, a variable rate encoder to encode the long term prediction lag and gain values may be provided to achieve low bit rates. Further, the long term prediction unit may comprise a noise vector buffer and/or a pulse vector buffer to enhance the prediction accuracy, e.g., for noisy or transient signals.

A joint coding unit to jointly encode pitch related information, such as long term prediction parameters, harmonic prediction parameters and time-warp parameters, may be provided. The joint encoding can further reduce the necessary bit rate by exploiting correlations in these parameters.

Another aspect of the invention relates to an audio decoder for decoding the bitstream generated by embodiments of the above encoder. The audio decoder comprises a de-quantization unit for de-quantizing a frame of the input bitstream; an inverse transformation unit for inverse transforming a transform domain signal; a long term prediction unit for determining an estimation of the de-quantized frame; a transform domain signal combination unit for combining, in the transform domain; the long term prediction estimation and the de-quantized frame to generate the transform domain signal; and a linear prediction unit for filtering the inverse transformed transform domain signal.

In addition, the decoder may comprise many of the aspects as disclosed above for the encoder. In general, the decoder will mirror the operations of the encoder, although some operations are only performed in the encoder and will have no corresponding components in the decoder. Thus, what is disclosed for the encoder is considered to be applicable for the decoder as well, if not stated otherwise.

The above aspects of the invention may be implemented as a device, apparatus, method, or computer program operating on a programmable device. The inventive aspects may further be embodied in signals, data structures and bitstreams.

Thus, the application further discloses an audio encoding method and an audio decoding method. An exemplary audio encoding method comprises the steps of: filtering an input signal based on an adaptive filter; transforming a frame of the filtered input signal into a transform domain; quantizing a transform domain signal; estimating the frame of the filtered input signal based on a reconstruction of a previous segment of the filtered input signal; and combining, in the transform domain, the long term prediction estimation and the transformed input signal to generate the transform domain signal.

An exemplary audio decoding method comprises the steps of: de-quantizing a frame of an input bitstream; inverse transforming a transform domain signal; determining an estimation of the de-quantized frame; combining, in the transform domain; the long term prediction estimation and the de-quantized frame to generate the transform domain signal; filtering the inversely transformed transform domain signal; and outputting a reconstructed audio signal.

These are only examples of preferred audio encoding/decoding methods and computer programs that are taught by the present application and that a person skilled in the art can derive from the following description of exemplary embodiments.

BRIEF DESCRIPTION OF THE DRAWINGS

The present invention will now be described by way of illustrative examples, not limiting the scope or spirit of the invention, with reference to the accompanying drawings, in which.

DESCRIPTION OF PREFERRED EMBODIMENTS

The below-described embodiments are merely illustrative for the principles of the present invention for audio encoder and decoder. It is understood that modifications and variations of the arrangements and the details described herein will be apparent to others skilled in the art. It is the intent, therefore, to be limited only by the scope of the accompanying patent claims and not by the specific details presented by way of description and explanation of the embodiments herein. Similar components of embodiments are numbered by similar reference numbers.

Figure 1:
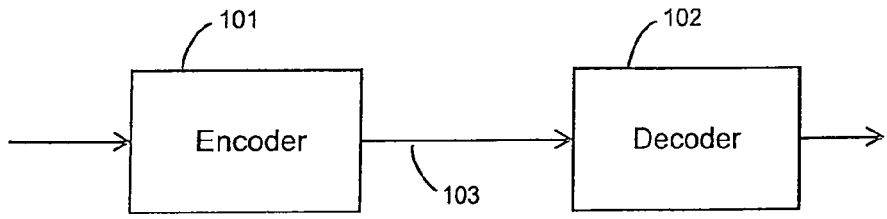
FIG. 1 illustrates a preferred embodiment of an encoder and a decoder according to the present invention.

In FIG. 1 an encoder 101 and a decoder 102 are visualized. The encoder 101 takes the time-domain input signal and produces a bitstream 103 subsequently sent to the decoder 102. The decoder 102 produces an output wave-form based on the received bitstream 103. The output signal psychoacoustically resembles the original input signal.

Figure 2:
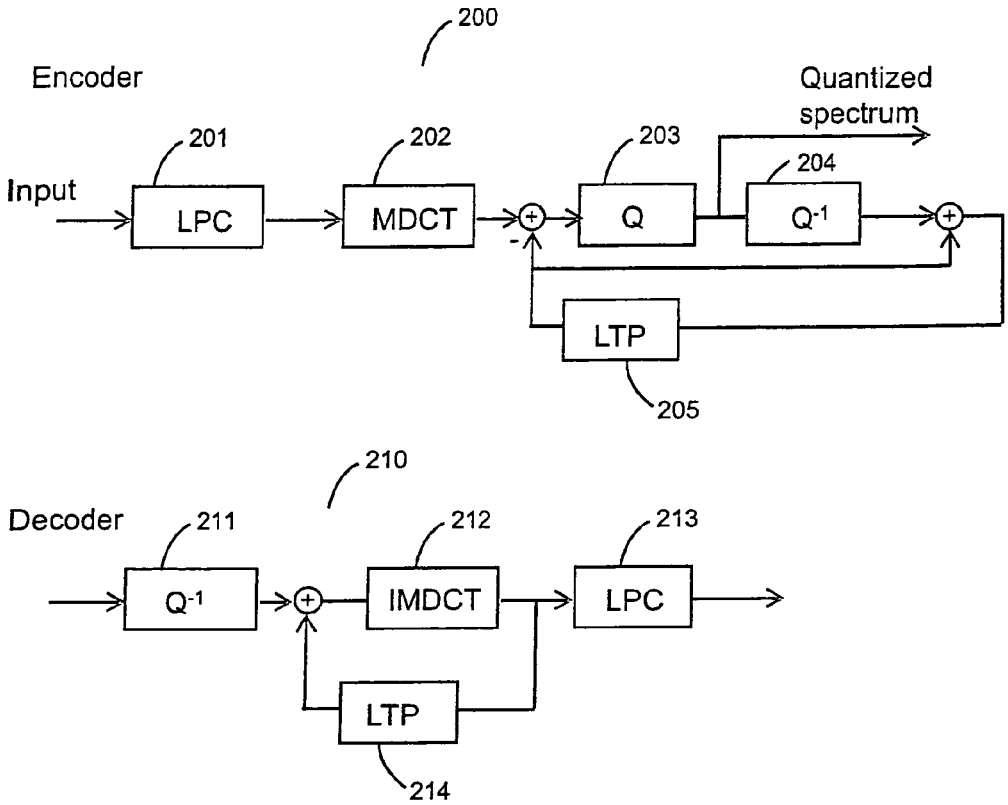
FIG. 2 illustrates a more detailed view of the encoder and the decoder according to the present invention.

In FIG. 2 a preferred embodiment of the encoder 200 and the decoders 210 are illustrated. The input signal in the encoder 200 is passed through a LPC (Linear Prediction Coding) module 201 that generates a whitened residual signal for an LPC frame having a first frame length, and the corresponding linear prediction parameters. Additionally, gain normalization may be included in the LPC module 201. The residual signal from the LPC is transformed into the frequency domain by an MDCT (Modified Discrete Cosine Transform) module 202 operating on a second variable frame length. In the encoder 200 depicted in FIG. 2, an LTP (Long Term Prediction) module 205 is included. LTP will be elaborated on in a further embodiment of the present invention. The MDCT lines are quantized 203 and also de-quantized 204 in order to feed a LTP buffer with a copy of the decoded output as will be available to the decoder 210. Due to the quantization distortion, this copy is called reconstruction of the respective input signal. In the lower part of FIG. 2 the decoder 210 is depicted. The decoder 210 takes the quantized MDCT lines, de-quantizes 211 them, adds the contribution from the LTP module 214, and does an inverse MDCT transform 212, followed by an LPC synthesis filter 213.

An important aspect of the above embodiment is that the MDCT frame is the only basic unit for coding, although the LPC has its own (and in one embodiment constant) frame size and LPC parameters are coded, too. The embodiment starts from a transform coder and introduces fundamental prediction and shaping modules from a speech coder. As will be discussed later, the MDCT frame size is variable and is adapted to a block of the input signal by determining the optimal MDCT window sequence for the entire block by minimizing a simplistic perceptual entropy cost function. This allows scaling to maintain optimal time/frequency control. Further, the proposed unified structure avoids switched or layered combinations of different coding paradigms.

Figure 3:
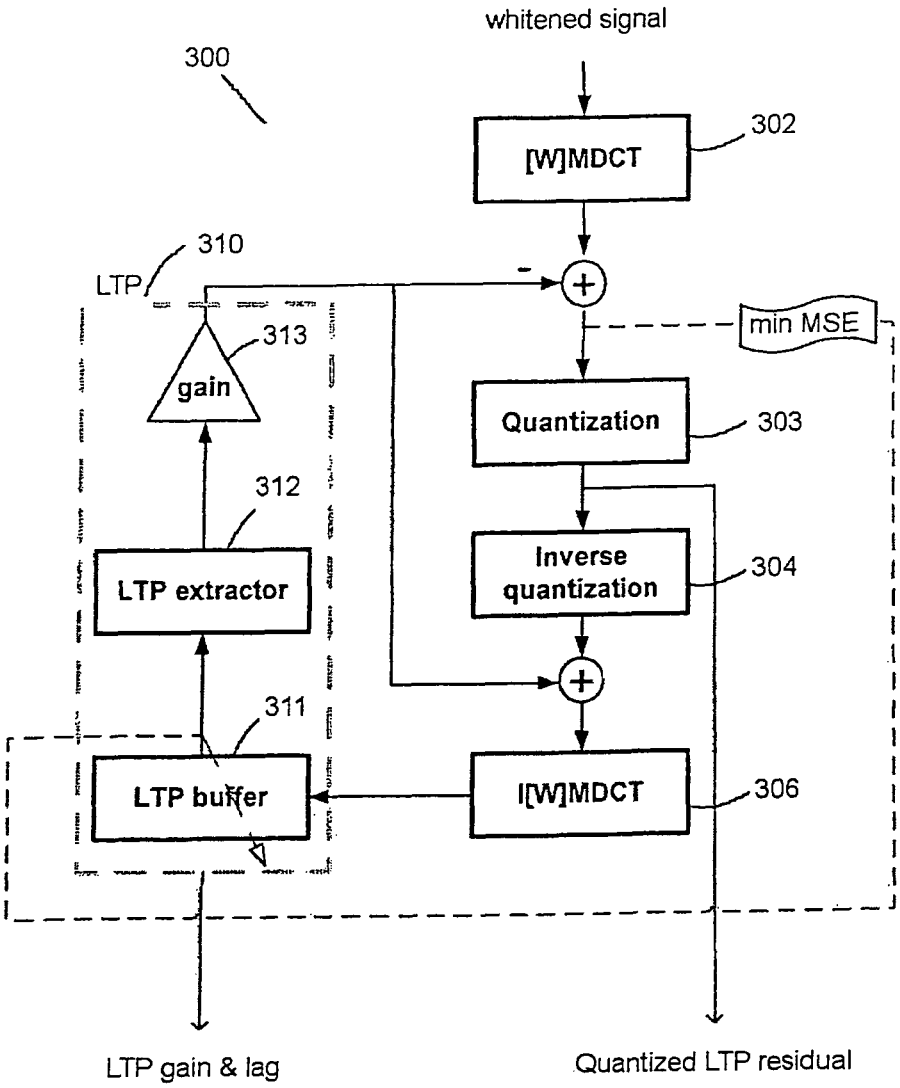
FIG. 3 illustrates another embodiment of the encoder according to the present invention.

In FIG. 3 parts of the encoder 300 are described schematically in more detail. The whitened signal as output from the LPC module 201 in the encoder of FIG. 2 is input to the MDCT filterbank 302. The MDCT analysis may optionally be a time-warped MDCT analysis that ensures that the pitch of the signal (if the signal is periodic with a well-defined pitch) is constant over the MDCT transform window.

In FIG. 3 the LTP module 310 is outlined in more detail. It comprises a LTP buffer 311 holding reconstructed time-domain samples of the previous output signal segments. A LTP extractor 312 finds the best matching segment in the LTP buffer 311 given the current input segment. A suitable gain value is applied to this segment by gain unit 313 before it is subtracted from the segment currently being input to the quantizer 303. Evidently, in order to do the subtraction prior to quantization, the LTP extractor 312 also transforms the chosen signal segment to the MDCT-domain. The LTP extractor 312 searches for the best gain and lag values that minimize an error function in the perceptual domain when combining the reconstructed previous output signal segment with the transformed MDCT-domain input frame. For instance, a mean squared error (MSE) function between the transformed reconstructed segment from the LTP module 310 and the transformed input frame (i.e. the residual signal after the subtraction) is optimized. This optimization may be performed in a perceptual domain where frequency components (i.e. MDCT lines) are weighted according to their perceptual importance. The LTP module 310 operates in MDCT frame units and the encoder 300 considers one MDCT frame residual at a time, for instance for quantization in the quantization module 303. The lag and gain search may be performed in a perceptual domain. Optionally, the LTP may be frequency selective, i.e. adapting the gain and/or lag over frequency. An inverse quantization unit 304 and an inverse MDCT unit 306 are depicted. The MDCT may be time-warped as explained later.

Figure 4:
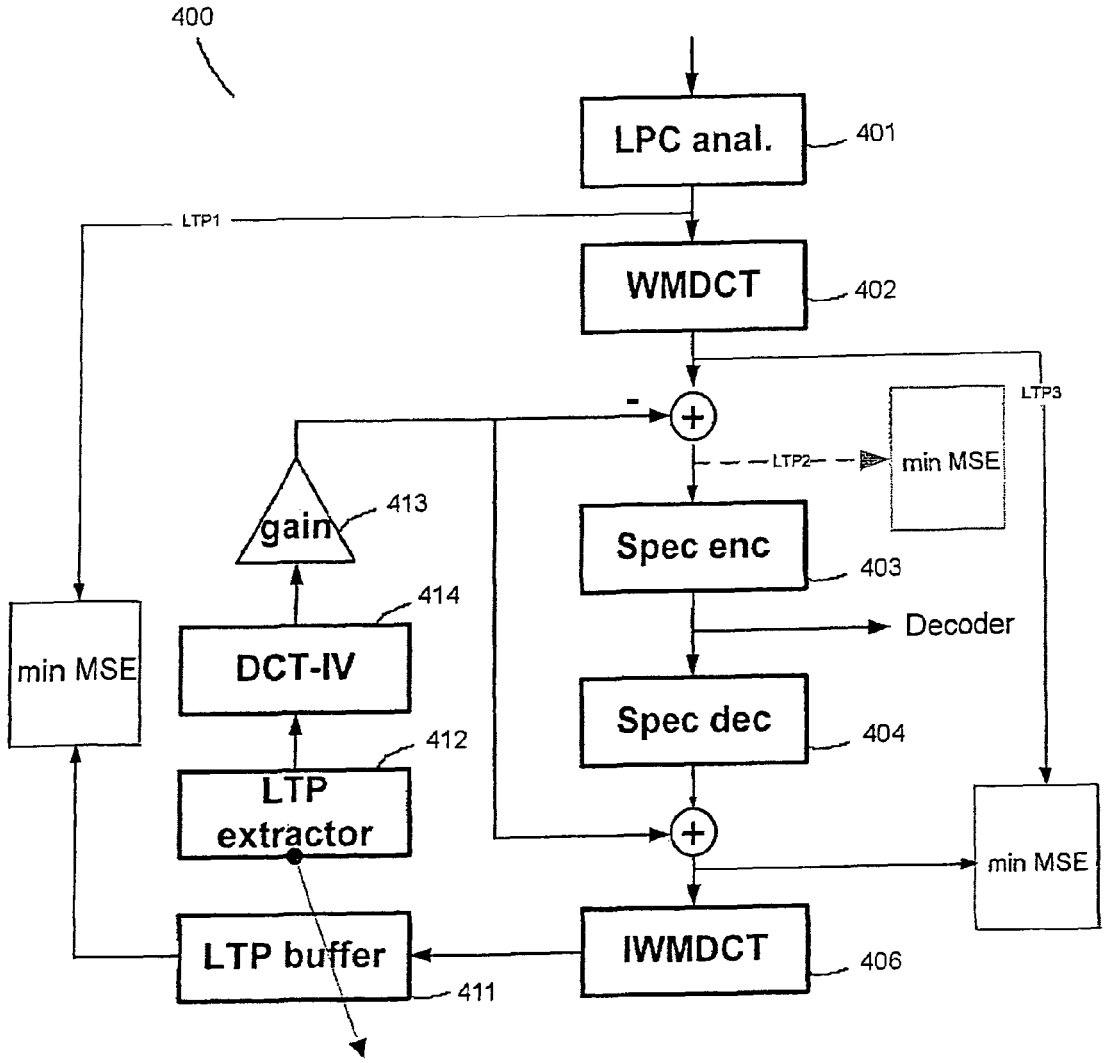
FIG. 4 illustrates a preferred embodiment of the encoder according to the present invention.

In FIG. 4 another embodiment of the encoder 400 is illustrated. In addition to FIG. 3, the LPC analysis 401 is included for clarification. A DCT-IV transform 414 used to transform a selected signal segment to the MDCT-domain is shown. Additionally, several ways of calculating the minimum error for the LTP segment selection are illustrated. In addition to the minimization of the residual signal as shown in FIG. 4 (identified as LTP2 in FIG. 4), the minimization of the difference between the transformed input signal and the de-quantized MDCT-domain signal before being inversely transformed to a reconstructed time-domain signal for storage in the LTP buffer 411 is illustrated (indicated as LTP3). Minimization of this MSE function will direct the LTP contribution towards an optimal (as possible) similarity of transformed input signal and reconstructed input signal for storage in the LTP buffer 411. Another alternative error function (indicated as LTP1) is based on the difference of these signals in the time-domain. In this case, the MSE between LPC filtered input frame and the corresponding time-domain reconstruction in the LTP buffer 411 is minimized. The MSE is advantageously calculated based on the MDCT frame size, which may be different from the LPC frame size. Additionally, the quantizer and de-quantizer blocks are replaced by the spectrum encoding block 403 and the spectrum decoding blocks 404 ("Spec enc" and "Spec dec") that may contain additional modules apart from quantization as will be outlined in FIG. 6. Again, the MDCT and inverse MDCT may be time-warped (WMDCT, IWMDCT).

Figure 5:
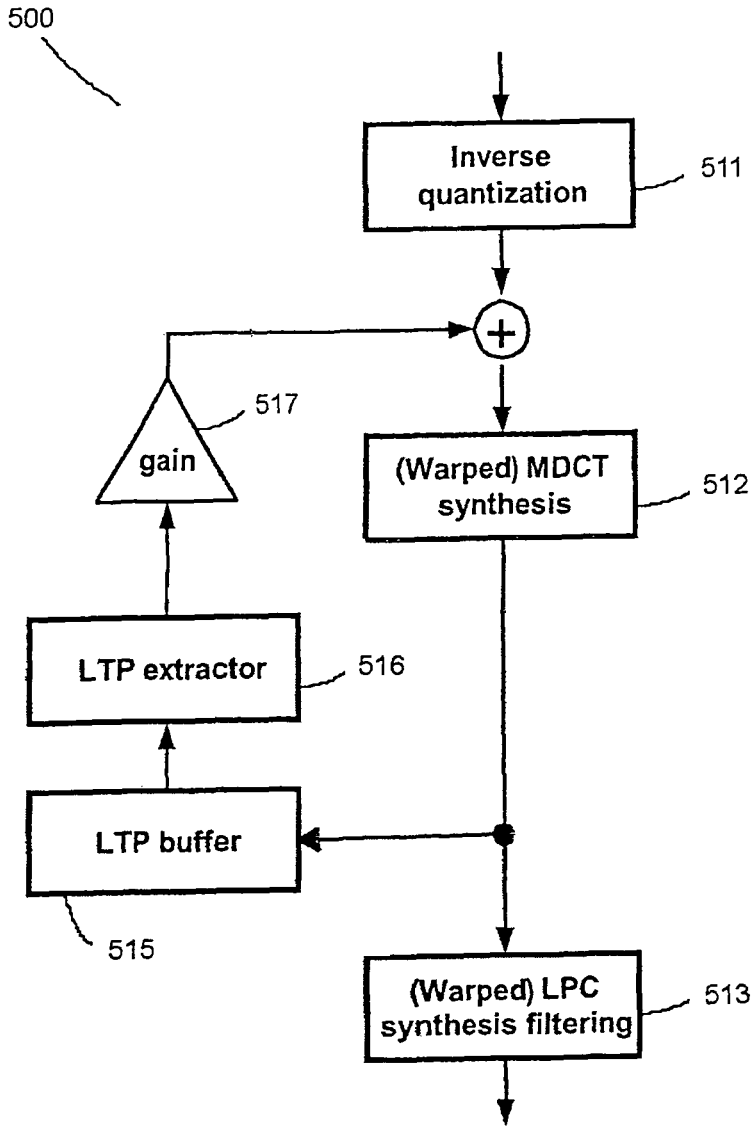
FIG. 5 illustrates a preferred embodiment of the decoder according to the present invention.

In FIG. 5 a proposed decoder 500 is illustrated. The spectrum data from the received bitstream is inversely quantized 511 and added with a LTP contribution provided by a LTP extractor from a LTP buffer 515. LTP extractor 516 and LTP gain unit 517 in the decoder 500 are illustrated, too. The summed MDCT lines are synthesized to the time-domain by a MDCT synthesis module, and the time-domain signal is spectrally shaped by a LPC synthesis filter 513. Optionally, the MDCT synthesis may be a time-warped MDCT, and/or the LPC synthesis filtering may be frequency warped.

Frequency-warped LPC is based on non-uniform sampling of the frequency axis to allow frequency selective control of LPC error contributions when determining the LPC filter parameters. While normal LPC is based on minimizing the MSE over a linear frequency axis so that the LPC polynomial is mostly accurate in the areas of spectral peaks, frequency-warped LPC allows a frequency selective focus when determining the LPC filter parameters. For instance, when operating on a higher bandwidth such as 16 or 24 kHz sampling rate, warping the frequency axis allows focusing the accuracy of the LPC polynomial on the lower frequency band such as frequencies up to 4 kHz.

Figure 6:
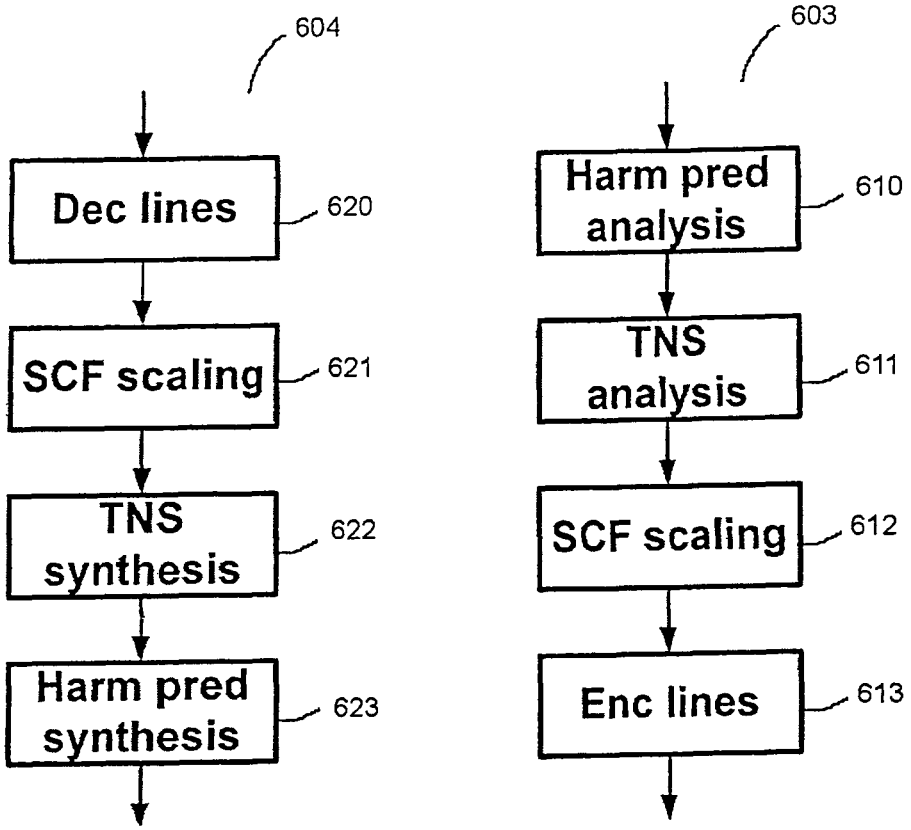
FIG. 6 illustrates a preferred embodiment of the MDCT lines encoding and decoding according to the present invention.

In FIG. 6 the "Spec dec" and "Spec enc" blocks 403, 404 of FIG. 4 are described in more detail. The "Spec enc" block 603 illustrated to the right in the figure comprises in an embodiment an Harmonic Prediction analysis module 610, a TNS analysis (Temporal Noise Shaping) module 611, followed by a scale-factor scaling module 612 of the MDCT lines, and finally quantization and encoding of the lines in a Enc lines module 613. The decoder "Spec Dec" block 604 illustrated to the left in the figure does the inverse process, i.e. the received MDCT lines are de-quantized in a Dec lines module 620 and the scaling is un-done by a scalefactor (SCF) scaling module 621. TNS synthesis 622 and Harmonic prediction synthesis 623 are applied, as will be explained below.

Figure 7:
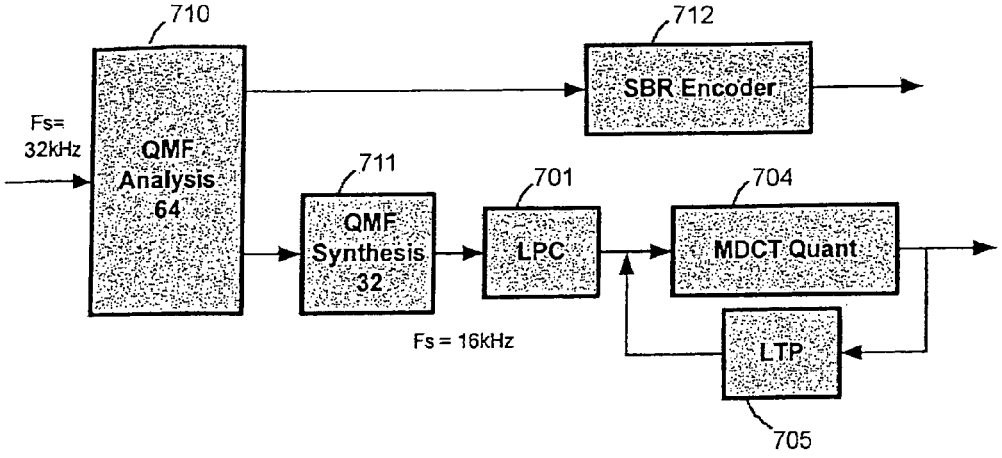
FIG. 7 illustrates a preferred embodiment of the present invention in combination with an SBR encoder.

In FIG. 7 another preferred embodiment of the present invention is outlined. In addition to the LPC 701, MDCT quantization 704, and LTP 705 as already outlined, a QMF analysis module 710 and a QMF synthesis module 711 are added, along with a SBR (Spectral Band Replication) module 712. A QMF (Quadrature Mirror Filter) filterbank has a certain number of subbands, in this particular example 64. A complex QMF filterbank allows independent manipulation of the subbands and without introducing frequency domain aliasing above the aliasing rejection level given the prototype filter used. A certain number of the lower (in frequency) subbands, in this particular example 32, are then synthesized to the time-domain, thus creating a downsampled signal, here by a factor of two. This is the input signal to the encoder modules as previously described. Using the QMF analysis and synthesis modules as resampler ensures that the LPC operates only on the reduced bandwidth on which also the following transform coder codes. The higher 32 subbands are sent to the SBR encoder module 712 that extracts relevant SBR parameters from the highband original signal. Alternatively, the input signal is supplied to a QMF analysis module, which in turn is connected to the SBR encoder, and a downsampling module which produces a downsampled signal for the transform encoder modules as previously described.

SBR (Spectral Band Replication) provides an efficient way of coding the high frequency part of a spectrum. It recreates the high frequencies of an audio signal from the low frequencies and a small amount of additional control information. Since the SBR method enables a reduction of the core coder bandwidth, and the SBR technique requires significantly lower bitrate to code the frequency range than a wave-form coder would, a coding gain can be achieved by reducing the bit rate allocated to the wave-form core coder while maintaining full audio bandwidth. Naturally, this gives the possibility to almost continuously decrease the total data rate by lowering the crossover frequency between core coder and the SBR part.

A perceptual audio coder may reduce bit rate by shaping the quantization noise so that it is always masked by the signal. This leads to a rather low signal to noise ratio, but as long as the quantization noise is put below the masking curve this does not matter. The distortion that the quantization represents is inaudible. However, when operated at low bit rates, the masking threshold will be violated, and the distortion becomes audible. One method that a perceptual audio coder can employ is to low pass filter the signal, i.e. only coding parts of the spectrum, since there is simply not enough bits to code the entire frequency range of the signal. For this situation, the SBR algorithm is very beneficial since it enables full audio bandwidth at low bit rates.

The SBR decoding concept comprises the following aspects:

- Highband re-creation is done by copying band-pass signals from the lowband, always excluding low frequencies.
- Spectral envelope information is sent from the encoder to the decoder making sure that the coarse spectral envelope of the reconstructed highband is correct.
- Additional information designed to compensate for shortcomings of the high frequency reconstruction may also be transmitted from the encoder to the decoder.
- Additional means such as inverse filtering, noise and sinusoidal addition, all of them likewise guided by transmitted information, may compensate for short-comings of any bandwidth extension method originating from occasional fundamental dissimilarities between lowband and highband.

Figure 8:
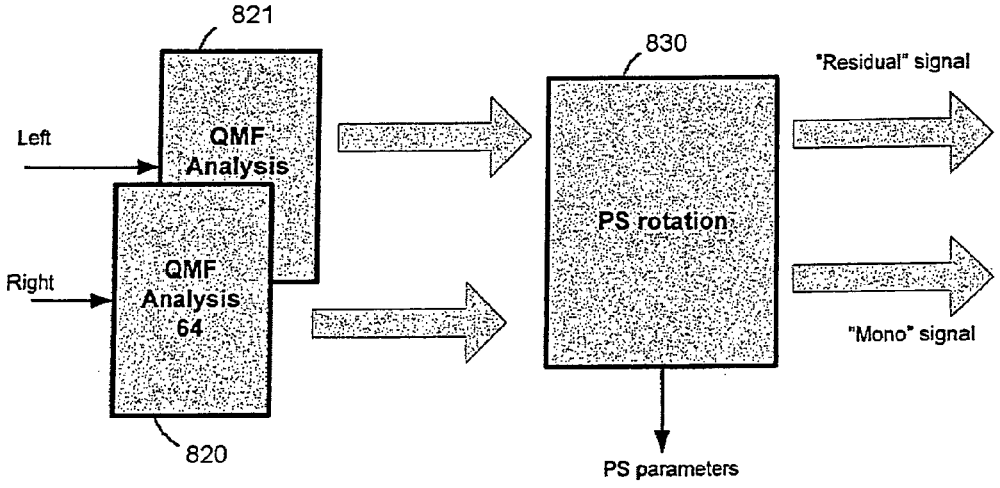
FIG. 8 illustrates a preferred embodiment of a stereo system.

In FIG. 8 an embodiment of the invention is extended to stereo, by adding two QMF analysis filterbanks 820, 821 for the left and right channels, and a rotation module 830, called parametric stereo (PS) module, that recreates two new signals from the two input signals in the QMF domain and corresponding rotation parameters. The two new signals represent a mono downmix and a residual signal. They can be visualizes as a Mid/Side transformation of the Left/Right stereo signals, where the Mid/Side stereo space is rotated so that the energy in the Mid signal (i.e. the downmix signal) is maximized, and the energy in the Side signal (i.e. the residual signal) is minimized. As a specific example, a mono source panned 45 degree to either the left or the right, will be present (at different levels) in both the left channel and the right channel. A prior art waveform audio coder typically chooses between coding the left and right channel independently or as a Mid/Side representation. For this particular example, neither the Left/Right representation nor the Mid/Side representation will be beneficial, since the panned mono source will be present in both channels disregarded the representation. However, if the Mid/Side representation is rotated 45 degrees, the panned mono source will end up entirely in the rotated Mid channel (here called the downmix channel), and the rotated Side channel will be zero (here called the residual channel). This offers a coding advantage over normal Left/Right or Mid/Side coding.

The two new signals, representing the stereo signal in combination with the extracted parameters, may subsequently be input, e.g., to the QMF synthesis modules and SBR modules as outlined in FIG. 7. For low bit rates, the residual signal can be low pass filtered or completely omitted. The parametric stereo decoder will replace the omitted residual signal by a decorrelated version of the downmix signal. Of course, this proposed processing of stereo signals can be combined with other embodiments of the present invention, too.

In more detail, the PS module compares the two input signals (left and right) for corresponding time/frequency tiles. The frequency bands of the tiles are designed to approximate a psycho-acoustically motivated scale, while the length of the segments is closely matched to known limitations of the binaural hearing system. Essentially, three parameters are extracted per time/frequency tile, representing the perceptually most important spatial properties:

(i) Inter-channel Level Difference (ILD), representing the level difference between the channels similarly to the "pan pot" on a mixing console.

(ii) Inter-channel Phase Difference (IPD), representing the phase difference between the channels. In the frequency domain this feature is mostly interchangeable with an Inter-channel Time Difference (ITD). The IPD is augmented by an additional Overall Phase Difference (OPD), describing the distribution of the left and right phase adjustment.

(iii) Inter-channel Coherence (IC), representing the coherence or cross-correlation between the channels. While the first two parameters are coupled to the direction of sound sources, the third parameter is more associated with a spatial diffuseness of the source.

Subsequent to parameter extraction, the input signals are downmixed to form a mono signal. The downmix can be made by trivial means of a summing process, but preferably more advanced methods incorporating time alignment and energy preservation techniques are incorporated to avoid potential phase cancellation in the downmix. On the decoder side, a PS decoding module is provided that basically comprises the reverse process of the corresponding encoder and reconstructs stereo output signals based on the PS parameters.

Figure 9:
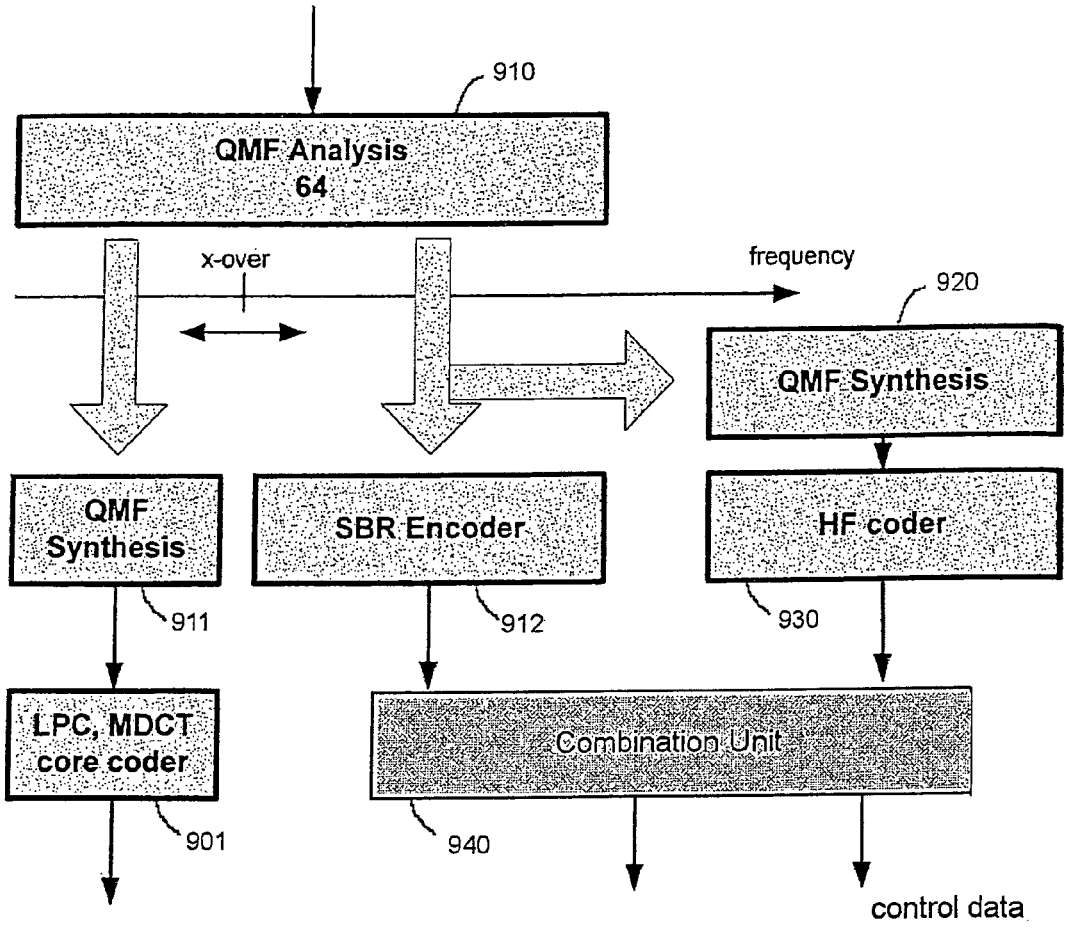
FIG. 9 illustrates a preferred embodiment of a more elaborate integration of core coder and high frequency reconstruction coding according to the present invention.

In FIG. 9 another embodiment of the present invention is outlined. Here the input signal is again analyzed by a 64 subband channel QMF module 920. However, contrary to the system outlined in FIG. 7, the border between the range covered by the core coder and the SBR coder is variable. Hence, the system synthesizes in module 911 as many subbands needed in order to cover the bandwidth of the time-domain signal that is subsequently to be coded by the LPC, MDCT and LTP module 901. The remaining (higher in frequency) subband samples are input to SBR encoder 912.

In addition to the earlier examples, the high subband samples may also be input to a QMF synthesis module 920 that synthesizes the higher frequency range to a low-pass signal, thus containing a down-modulated high frequency range. This signal is subsequently coded by an additional MDCT-based MDCT-based coder 930. The output from the additional MDCT-based MDCT-based coder 930 may be combined with the SBR encoder output in an optional combination unit 940. Signaling is generated and sent to the decoder indicating which part is coded with SBR, and which part is coded with the MDCT-based wave-form coder. This enables a smooth transition from SBR encoding to wave-form coding. Further, freedom of choice with regards to transform sizes used in the MDCT coding for the lower frequencies and the higher frequencies is enabled, since they are coded with separate MDCT transforms.

Figure 10:
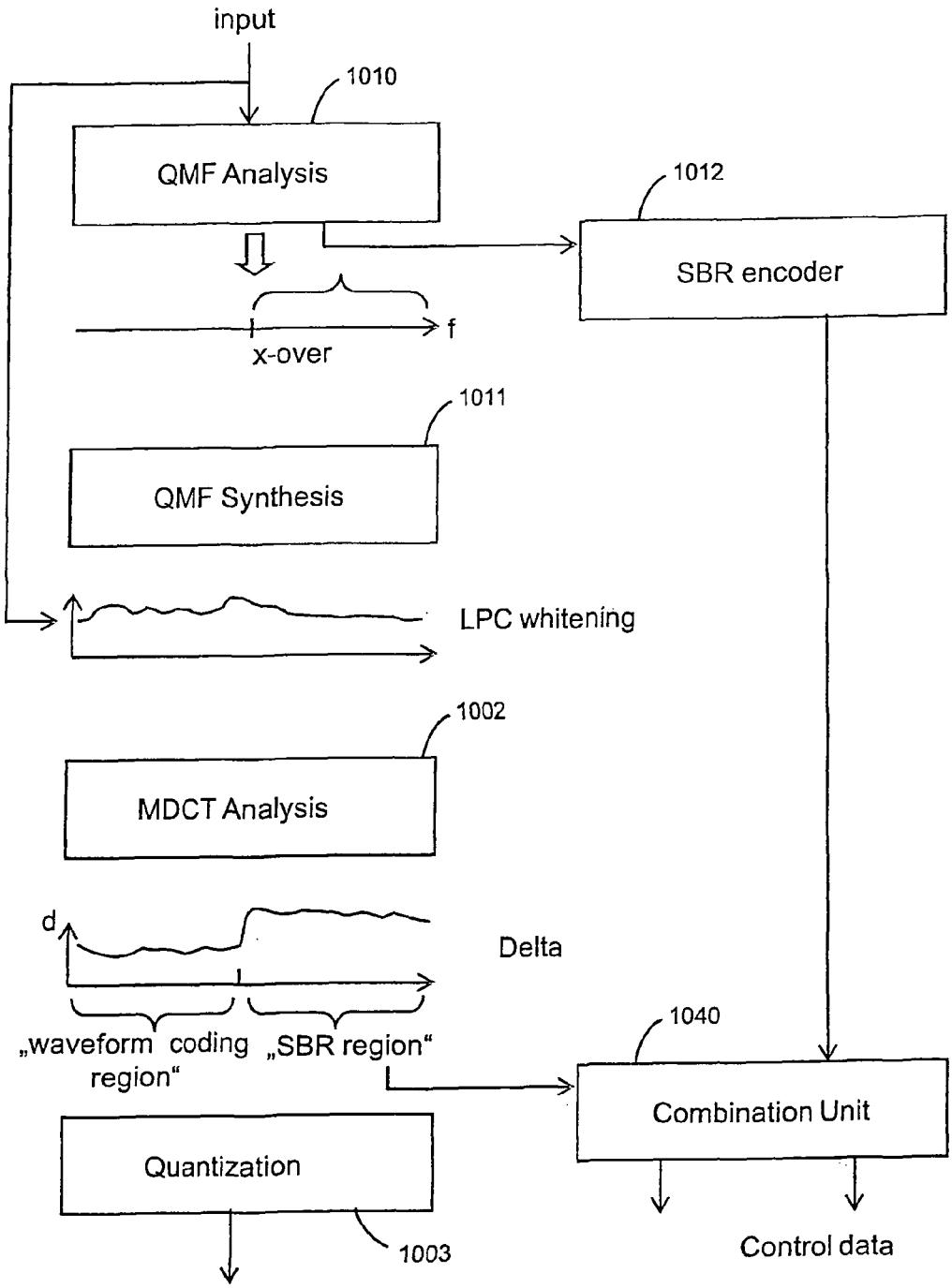
FIG. 10 illustrates a preferred embodiment of the combination of SBR encoding and the core coder according to the present invention.

In FIG. 10 another embodiment is outlined. The input signal is input to an QMF analysis module 1010. The output subbands corresponding to the SBR range are input to SBR encoder 1012. LPC analysis and filtering is done by covering the entire frequency range of the signal, and is done using either directly the input signal, or a synthesized version of the QMF subband signal generated by the QMF synthesis module 1011. The latter is useful when combined with the stereo implementation of FIG. 8. The LPC filtered signal is input to MDCT analysis module 1002 providing spectral lines to be) coded. In this embodiment of the invention, quantization 1003 is arranged so that a significantly coarser quantization takes place in the SBR region (i.e. the frequency region also covered by the SBR encoder), thus only covering the strongest spectral lines. This information is input to a combination unit 1040 that, given the quantized spectrum and the SBR encoded data, provides signaling to the decoder what signal to use for different frequency ranges in the SBR range, i.e. either SBR data or wave-form coded data.

Figure 11:
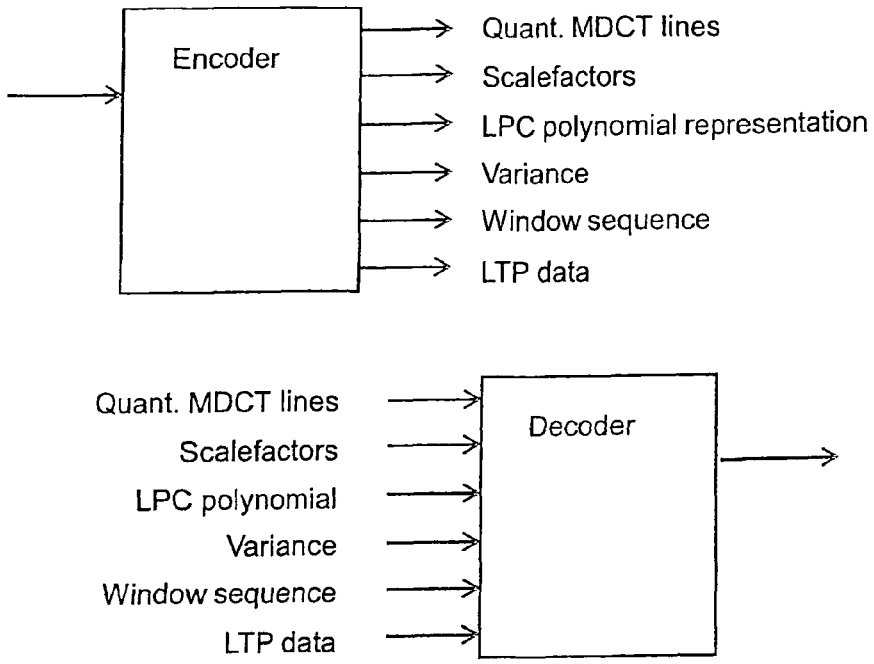
FIG. 11 illustrates a preferred embodiment of the encoder and decoder, and examples of relevant control data transmitted from one to the other, according to the present invention.

In FIG. 11 a very general illustration of the inventive coding system is outlined. The exemplary encoder takes the input signal and produces a bitstream containing, among other data:

quantized MDCT lines;
scalefactors;
LPC polynomial representation;
signal segment energy (e.g. signal variance);
window sequence;
LTP data.

The decoder according to the embodiment reads the provided bitstream and produces an audio output signal, psycho-acoustically resembling the original signal.

Figure 11A:
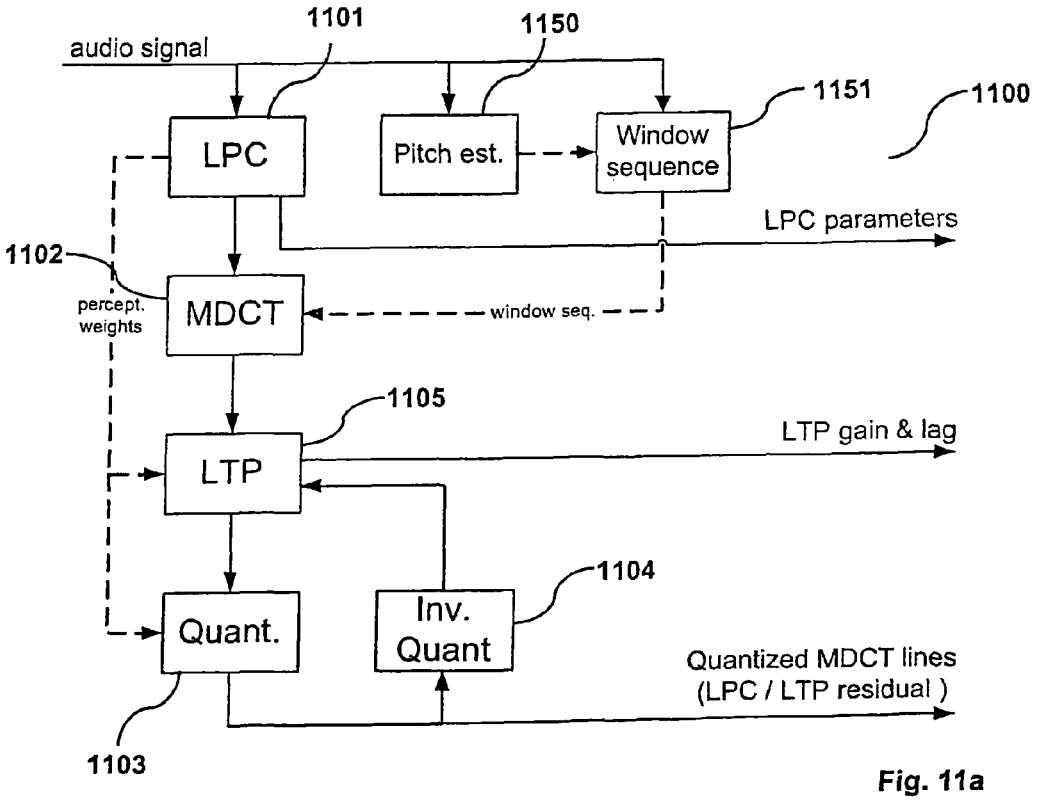
FIG. 11*a* is another illustration of aspects of the encoder according to an embodiment of the invention.

FIG. 11*a* is another illustration of aspects of an encoder 1100 according to an embodiment of the invention. The encoder 1100 comprises an LPC module 1101, a MDCT module 1104, a LTP module 1105 (shown only simplified), a quantization module 1103 and an inverse quantization module 1104 for feeding back reconstructed signals to the LTP module 1105. Further provided are a pitch estimation module 1150 for estimating the pitch of the input signal, and a window sequence determination module 1151 for determining the optimal MDCT window sequence for a larger block of the input signal (e.g. 1 second). In this embodiment, the MDCT window sequence is determined based on an open-loop approach where sequence of MDCT window size candidates is determined that minimizes a coding cost function, e.g. a simplistic perceptual entropy. The contribution of the LTP module 1105 to the coding cost function that is minimized by the window sequence determination module 1151 may optionally be considered when searching for the optimal MDCT window sequence. Preferably, for each evaluated window size candidate, the best long term prediction contribution to the MDCT frame corresponding to the window size candidate is determined, and the respective coding cost is estimated. In general, short MDCT frame sizes are more appropriate for speech input while long transform windows having a fine spectral resolution are preferred for audio signals.

Perceptual weights or a perceptual weighting function are determined based on the LPC parameters as calculated by the LPC module 1101, which will be explained in more detail below. The perceptual weights are supplied to the LTP module 1105 and the quantization module 1103, both operating in the MDCT-domain, for weighting error or distortion contributions of frequency components according to their respective perceptual importance. FIG. 11*a* further illustrates which coding parameters are transmitted to the decoder, preferably by an appropriate coding scheme as will be discussed later.

Next, the coexistence of LPC and MDCT data and the emulation of the effect of the LPC in the MDCT, both for counteraction and actual filtering omission, will be discussed.

According to an embodiment, the LP module filters the input signal so that the spectral shape of the signal is removed, and the subsequent output of the LP module is a spectrally flat signal. This is advantageous for the operation of, e.g., the LTP. However, other parts of the codec operating on the spectrally flat signal may benefit from knowing what the spectral shape of the original signal was prior to LP filtering. Since the encoder modules, after the filtering, operate on the MDCT transform of the spectrally flat signal, the present invention teaches that the spectral shape of the original signal prior to LP filtering can, if needed, be re-imposed on the MDCT representation of the spectrally flat signal by mapping the transfer function of the used LP filter (i.e. the spectral envelope of the original signal) to a gain curve, or equalization curve, that is applied on the frequency bins of the MDCT representation of the spectrally flat signal. Conversely, the LP module can omit the actual filtering, and only estimate a transfer function that is subsequently mapped to a gain curve which can be imposed on the MDCT representation of the signal, thus removing the need for time domain filtering of the input signal.

One prominent aspect of embodiments of the present invention is that an MDCT-based transform coder is operated using a flexible window segmentation, on a LPC whitened signal. This is outlined in FIG. 12, where an exemplary MDCT window sequence is given, along with the windowing of the LPC. Hence, as is clear from the figure, the LPC operates on a constant frame-size (e.g. 20 ms), while the MDCT operates on a variable window sequence (e.g. 4 to 128 ms). This allows for choosing the optimal window length for the LPC and the optimal window sequence for the MDCT independently.

Figure 12:
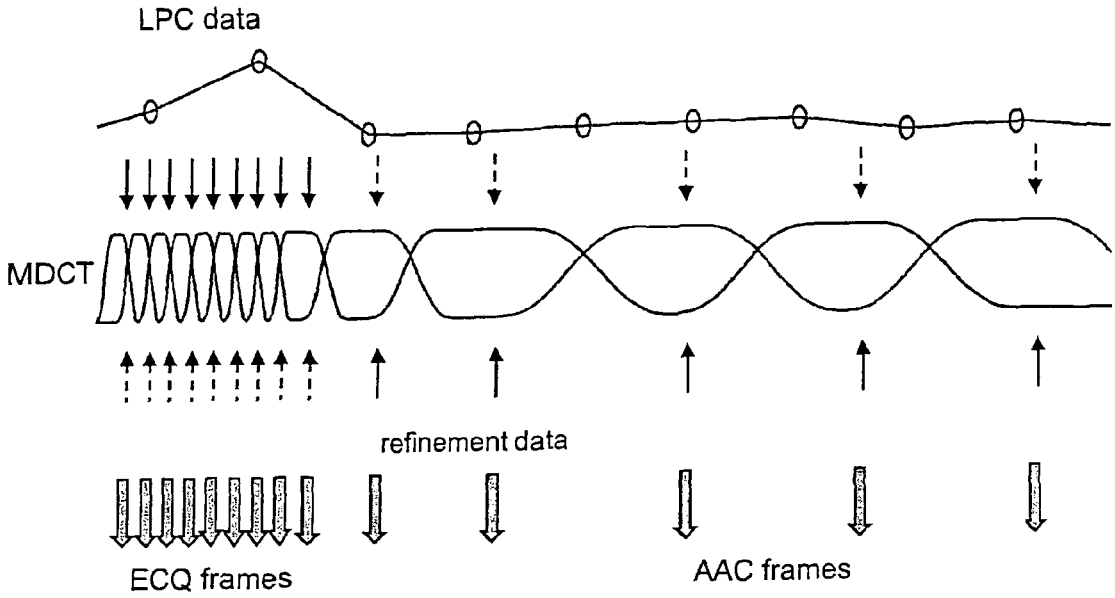
FIG. 12 illustrates an example of a window sequence and the relation between LPC data and MDCT data according to an embodiment of the present invention.

FIG. 12 further illustrates the relation between LPC data, in particular the LPC parameters, generated at a first frame rate and MDCT data, in particular the MDCT lines, generated at a second variable rate. The downward arrows in the figure symbolize LPC data that is interpolated between the LPC frames (circles) so as to match corresponding MDCT frames. For instance, a LPC-generated perceptual weighting function is interpolated for time instances as determined by the MDCT window sequence. The upward arrows symbolize refinement data (i.e. control data) used for the MDCT lines coding. For the AAC frames this data is typically scalefactors, and for the ECQ frames the data is typically variance correction data etc. The solid vs dashed lines represent which data is the most "important" data for the MDCT lines coding given a certain quantizer. The double downward arrows symbolize the coded spectral lines.

The coexistence of LPC and MDCT data in the encoder may be exploited, for instance, to reduce the bit requirements of encoding MDCT scalefactors by taking into account a perceptual masking curve estimated from the LPC parameters. Furthermore, LPC derived perceptual weighting may be used when determining quantization distortion. As illustrated and as will be discussed below, the quantizer operates in two modes and generates two types of frames (ECQ frames and AAC frames) depending on the frame size of received data, i.e. corresponding to the MDCT frame or window size.

Figure 15:
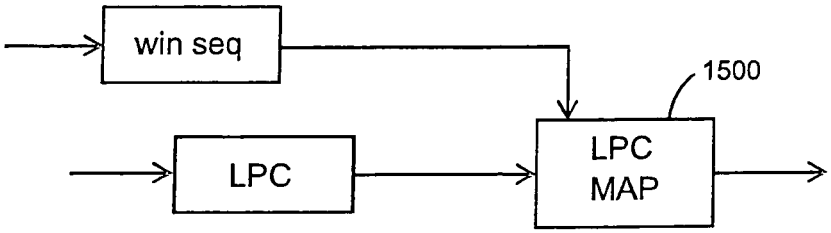
FIG. 15 illustrates a preferred embodiment of mapping the constant update rate LPC parameters to the adaptive MDCT window sequence data, according to the present invention.

FIG. 15 illustrates a preferred embodiment of mapping the constant rate LPC parameters to adaptive MDCT window sequence data. A LPC mapping module 1500 receives the LPC parameters according to the LPC update rate. In addition, the LPC mapping module 1500 receives information on the MDCT window sequence. It then generates a LPC-to-MDCT mapping, e.g., for mapping LPC-based psychoacoustic data to respective MDCT frames generated at the variable MDCT frame rate. For instance, the LPC mapping module interpolates LPC polynomials or related data for time instances corresponding to MDCT frames for usage, e.g., as perceptual weights in LTP module or quantizer.

Figure 13:
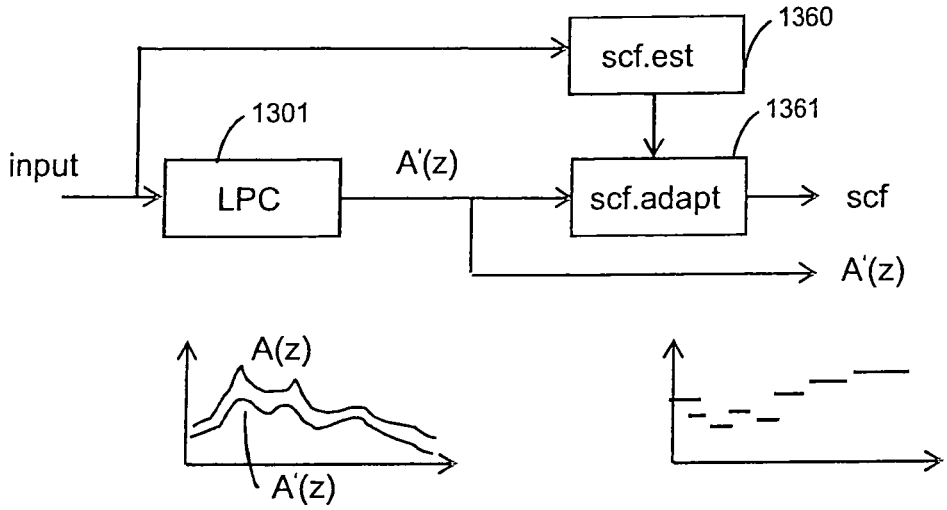
FIG. 13 illustrates a combination of scale-factor data and LPC data according to the present invention.

Now, specifics of the LPC-based perceptual model are discussed by referring to FIG. 13. The LPC module 1301 is in an embodiment of the present invention adapted to produce a white output signal, by using linear prediction of, e.g., order 16 for a 16 kHz sampling rate signal. For example, the output from the LPC module 201 in FIG. 2 is the residual after LPC parameter estimation and filtering. The estimated LPC polynomial A(z), as schematically visualized in the lower left of FIG. 13, may be chirped by a bandwidth expansion factor, and also tilted by, in one implementation of the invention, modifying the first reflection coefficient of the corresponding LPC polynomial. Chirping expands the bandwidth of peaks in the LPC transfer function by moving the poles of the polynomial inwards into the unit circle, thus resulting in softer peaks. Tilting allows making the LPC transfer function flatter in order to balance the influence of lower and higher frequencies. These modifications strive to generate a perceptual masking curve A'(z) from the estimated LPC parameters that will be available on both the encoder and the decoder side of the system. Details to the manipulation of the LPC polynomial are presented in FIG. 16 below.

The MDCT coding operating on the LPC residual has, in one implementation of the invention, scalefactors to control the resolution of the quantizer or the quantization step sizes (and, thus, the noise introduced by quantization). These scalefactors are estimated by a scalefactor estimation module 1360 on the original input signal. For example, the scalefactors are derived from a perceptual masking threshold curve estimated from the original signal. In an embodiment, a separate frequency transform (having possibly a different frequency resolution) may be used to determine the masking threshold curve, but this is not always necessary. Alternatively, the masking threshold curve is estimated from the MDCT lines generated by the transformation module. The bottom right part of FIG. 13 schematically illustrates scalefactors generated by the scalefactor estimation module 1360 to control quantization so that the introduced quantization noise is limited to inaudible distortions.

If a LPC filter is connected upstream of the MDCT transformation module, a whitened signal is transformed to the MDCT-domain. As this signal has a white spectrum, it is not well suited to derive a perceptual masking curve from it. Thus, a MDCT-domain equalization gain curve generated to compensate the whitening of the spectrum may be used when estimating the masking threshold curve and/or the scalefactors. This is because the scalefactors need to be estimated on a signal that has absolute spectrum properties of the original signal, in order to correctly estimate perceptually masking.

The calculation of the MDCT-domain equalization gain curve from the LPC polynomial is discussed in more detail with reference to FIG. 14 below.

Using the above outlined approach, the data transmitted between the encoder and decoder contains both the LP polynomial from which the relevant perceptual information as well as a signal model can be derived when a model-based quantizer is used, and the scalefactors commonly used in a transform codec.

In more detail, returning to FIG. 13, the LPC module 1301 in the figure estimates from the input signal a spectral envelope A(z) of the signal and derives from this a perceptual representation A'(z). In addition, scalefactors as normally used in transform based perceptual audio codecs are estimated on the input signal, or they may be estimated on the white signal produced by a LP filter, if the transfer function of the LP filter is taken into account in the scalefactor estimation (as described in the context of FIG. 14 below). The scalefactors may then be adapted in scalefactor adaptation module 1361 given the LP polynomial, as will be outlined below, in order to reduce the bit rate required to transmit scalefactors.

Normally, the scalefactors are transmitted to the decoder, and so is the LP polynomial. Now, given that they are both estimated from the original input signal and that they both are somewhat correlated to the absolute spectrum properties of the original input signal, it is proposed to code a delta representation between the two, in order to remove any redundancy that may occur if both were transmitted separately. According to an embodiment, this correlation is exploited as follows. Since the LPC polynomial, when correctly chirped and tilted, strives to represent a masking threshold curve, the two representations may be combined so that the transmitted scalefactors of the transform coder represent the difference between the desired scalefactors and those that can be derived from the transmitted LPC polynomial. The scalefactor adaptation module 1361 shown in FIG. 13 therefore calculates the difference between the desired scalefactors generated from the original input signal and the LPC-derived scalefactors. This aspect retains the ability to have a MDCT-based quantizer that has the notion of scalefactors as commonly used in transform coders, within an LPC structure, operating on a LPC residual, and still have the possibility to switch to a model-based quantizer that derives quantization step sizes solely from the linear prediction data.

Figure 14:
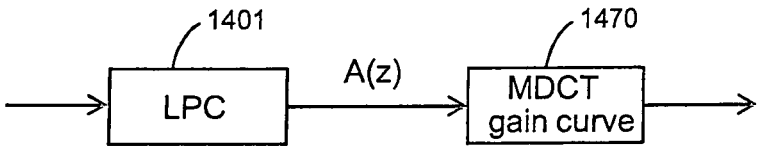
FIG. 14 illustrates a preferred embodiment of translating LPC polynomials to a MDCT gain curve according to the present invention.

FIG. 14 illustrates a preferred embodiment of translating LPC polynomials into a MDCT gain curve. As outlined in FIG. 2, the MDCT operates on a whitened signal, whitened by the LPC filter 1401. In order to retain the spectral envelope of the original input signal, a MDCT gain curve is calculated by the MDCT gain curve module 1470. The MDCT-domain equalization gain curve may be obtained by estimating the magnitude response of the spectral envelope described by the LPC filter, for the frequencies represented by the bins in the MDCT transform. The gain curve may then be applied on the MDCT data, e.g., when calculating the minimum mean square error signal as outlined in FIG. 3, or when estimating a perceptual masking curve for scalefactor determination as outlined with reference to FIG. 13 above.

Figure 16:
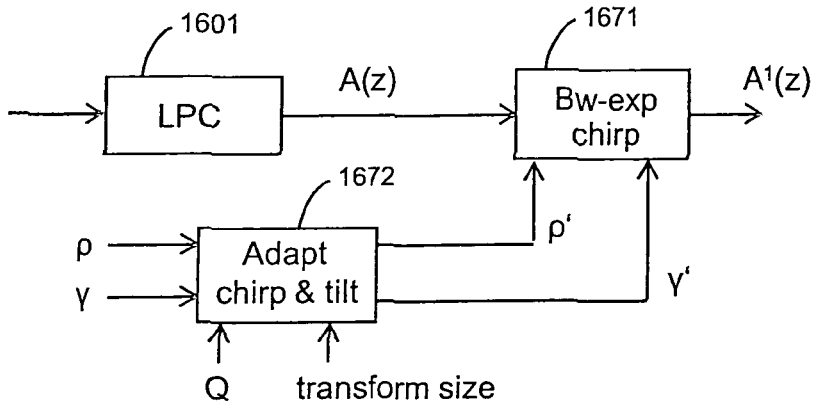
FIG. 16 illustrates a preferred embodiment of adapting the perceptual weighting filter calculation based on transform size and type of quantizer, according to the present invention.

FIG. 16 illustrates a preferred embodiment of adapting the perceptual weighting filter calculation based on transform size and/or type of quantizer. The LP polynomial A(z) is estimated by the LPC module 1601 in FIG. 16. A LPC parameter modification module 1671 receives LPC parameters, such as the LPC polynomial A(z), and generates a perceptual weighting filter A'(z) by modifying the LPC parameters. For instance, the bandwidth of the LPC polynomial A(z) is expanded and/or the polynomial is tilted. The input parameters to the adapt chirp & tilt module 1672 are the default chirp and tilt values ρ and γ. These are modified given predetermined rules, based on the transform size used, and/or the quantization strategy Q used. The modified chirp and tilt parameters ρ' and γ' are input to the LPC parameter modification module 1671 translating the input signal spectral envelope, represented by A(z), to a perceptual masking curve represented by A'(z).

Figure 17:
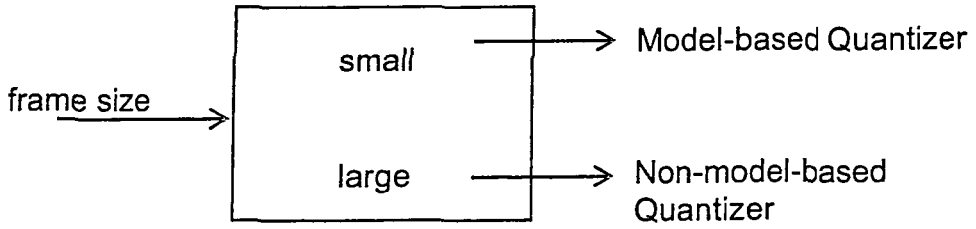
FIG. 17 illustrates a preferred embodiment of adapting the quantizer dependent on the frame size, according to the present invention.

In the following, the quantization strategy conditioned on frame-size, and the model-based quantization conditioned on assorted parameters according to an embodiment of the invention will be explained. One aspect of the present invention is that it utilizes different quantization strategies for different transform sizes or frame sizes. This is illustrated in FIG. 17, where the frame size is used as a selection parameter for using a model-based quantizer or a non-model based quantizer. It must be noted that this quantization aspect is independent of other aspects of the disclosed encoder/decoder and may be applied in other codecs as well. An example of a non-model based quantizer is Huffman table based quantizer used in the AAC audio coding standard. The model-based quantizer may be an Entropy Constraint Quantizer (ECQ) employing arithmetic coding. However, other quantizers may be used in embodiments of the present invention as well. Furthermore, in the presently outlined embodiment of the present invention, the quantizer of choice is implicitly signaled to the decoder by means of transform size. It should be clear that other means of signaling could be used as well, e.g. explicitly sending information to the decoder on which quantization strategy has been used for a particular frame-size.

According to an independent aspect of the present invention, it is suggested to switch between different quantization strategies as function of frame size in order to be able to use the optimal quantization strategy given a particular frame size. As an example, the window-sequence may dictate the usage of a long transform for a very stationary tonal music segment of the signal. For this particular signal type, using a long transform, it is highly beneficial to employ a quantization strategy that can take advantage of "sparse" character (i.e. well defined discrete tones) in the signal spectrum.

A quantization method as used in AAC in combination with Huffman tables and grouping of spectral lines, also as used in AAC, is very beneficial. However, and on the contrary, for speech segments, the window-sequence may, given the coding gain of the LTP, dictate the usage of short transforms. For this signal type and transform size it is beneficial to employ a quantization strategy that does not try to find or introduce sparseness in the spectrum, but instead maintains a broadband energy that, given the LTP, will retain the pulse like character of the original input signal.

Figure 18:
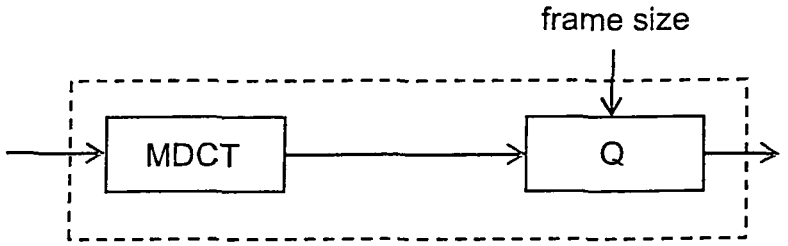
FIG. 18 illustrates a preferred embodiment of adapting the quantizer dependent on the frame size, according to the present invention.

A more general visualization of this concept is given in FIG. 18, where the input signal is transformed into the MDCT-domain, and subsequently quantized by a quantizer controlled by the transform size or frame size used for the MDCT transform.

Figure 19:
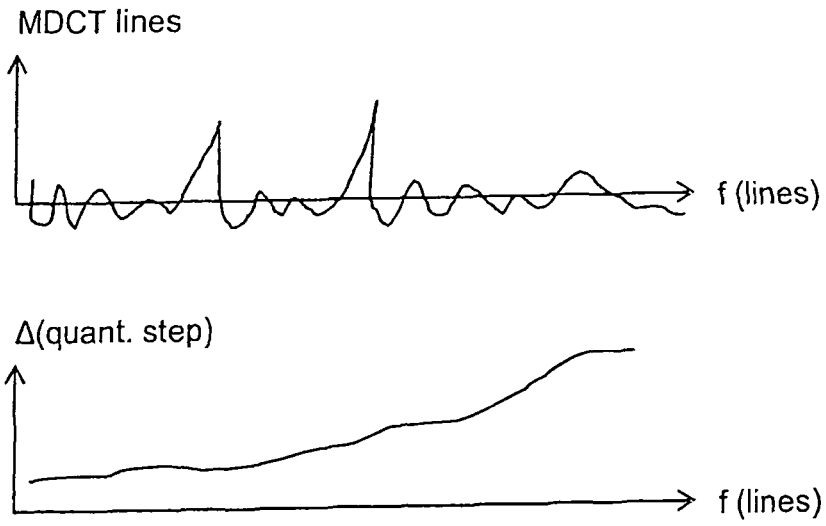
FIG. 19 illustrates a preferred embodiment of adapting the quantization step size as a function of LPC and LTP data, according to the present invention.
Figure 19A:
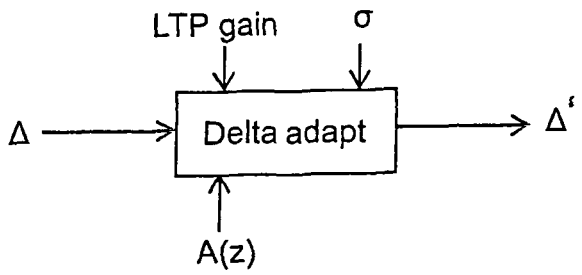
FIG. 19*a* illustrates how a delta-curve is derived from LPC and LTP parameters by means of a delta-adapt module.

According to another aspect of the invention, the quantizer step size is adapted as function of LPC and/or LTP data. This allows a determination of the step size depending on the difficulty of a frame and controls the number of bits that are allocated for encoding the frame. In FIG. 19 an illustration is given on how model-based quantization may be controlled by LPC and LTP data. In the top part of FIG. 19, a schematic visualization of MDCT lines is given. Below the quantization step size delta A as a function of frequency is depicted. It is clear from this particular example that the quantization step size increases with frequency, i.e. more quantization distortion is incurred for higher frequencies. The delta-curve is derived from the LPC and LTP parameters by means of a delta-adapt module depicted in FIG. 19*a*. The delta curve may further be derived from the prediction polynomial A(z) by chirping and/or tilting as explained with reference to FIG. 13.

A preferred perceptual weighting function derived from LPC data is given in the following equation:

$$P(z) = \frac{1 - (1 - \tau) r_1 z^{-1}}{A(z/\rho)}$$

where A(z) is the LPC polynomial, τ is a tilting parameter, ρ controls the chirping and $r_1$ is the first reflection coefficient calculated from the A(z) polynomial. It is to be noted that the A(z) polynomial can be re-calculate to an assortment of different representations in order to extract relevant information from the polynomial. If one is interested in the spectral slope in order to apply a "tilt" to counter the slope of the spectrum, re-calculation of the polynomial to reflection coefficients is preferred, since the first reflection coefficient represents the slope of the spectrum.

In addition, the delta values Δ may be adapted as a function of the input signal variance σ, the LTP gain g, and the first reflection coefficient $r_1$ derived from the prediction polynomial. For instance, the adaptation may be based on the following equation:

$$\Delta'=\Delta(1+r_1(1-g^2))$$

Figure 20:
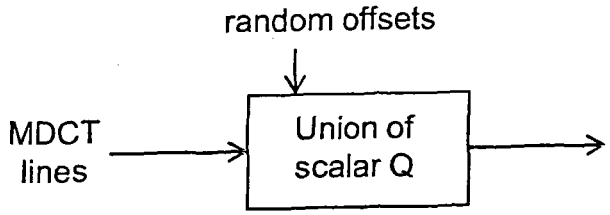
FIG. 20 illustrates a preferred embodiment of a model-based quantizer utilizing random offsets, according to the present invention.

In the following, aspects of model-based quantizers according to an embodiment of the present invention are outlined. In FIG. 20 one of the aspects of the model-based quantizer is visualized. The MDCT lines are input to a quantizer employing uniform scalar quantizers. In addition, random offsets are input to the quantizer, and used as offset values for the quantization intervals shifting the interval borders. The proposed quantizer provides vector quantization advantages while maintaining searchability of scalar quantizers. The quantizer iterates over a set of different offset values, and calculates the quantization error for these. The offset value (or offset value vector) that minimizes the quantization distortion for the particular MDCT lines being quantized is used for quantization. The offset value is then transmitted to the decoder along with the quantized MDCT lines. The use of random offsets introduces noise-filling in the de-quantized decoded signal and, by doing so, avoids spectral holes in the quantized spectrum. This is particularly important for low bit rates where many MDCT lines are otherwise quantized to a zero value which would lead to audible holes in the spectrum of the reconstructed signal.

Figure 21:
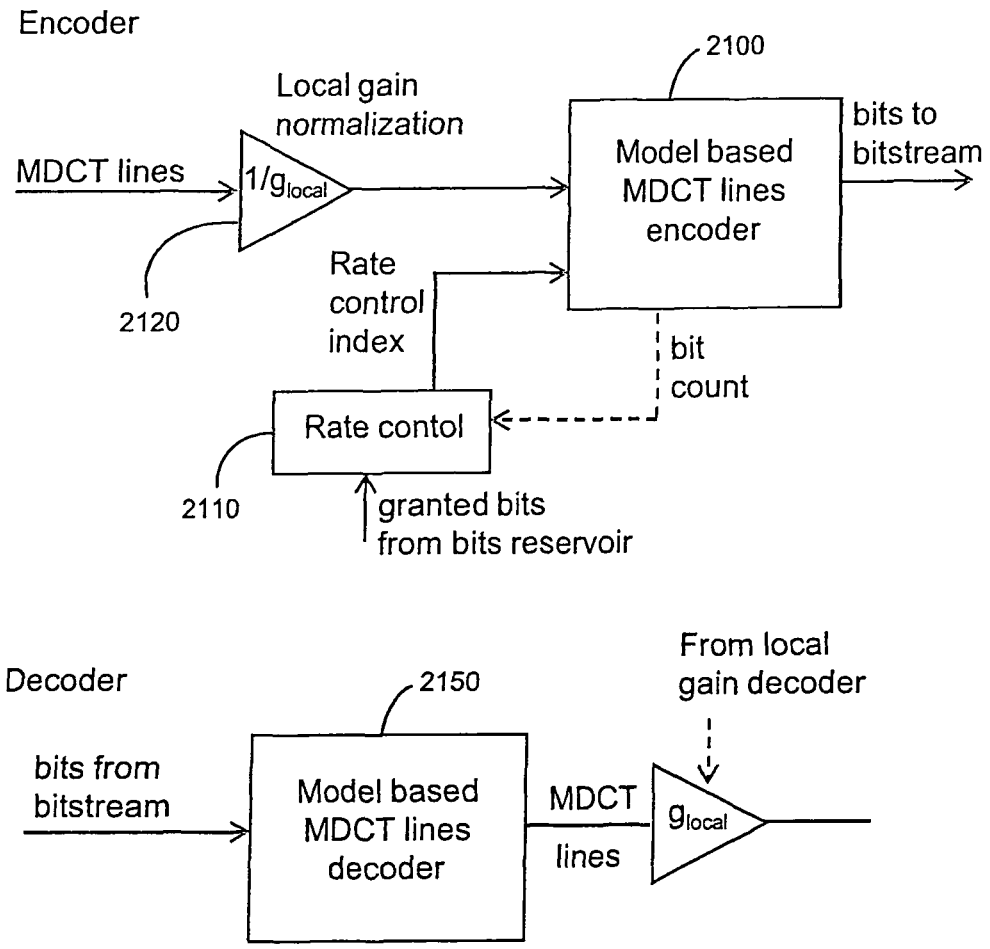
FIG. 21 illustrates a preferred embodiment of a model-based quantizer according to the present invention.

FIG. 21 illustrates schematically a Model Based MDCT Lines Quantizer (MBMLQ) according to an embodiment of the invention. The top of FIG. 21 depicts a MBMLQ encoder 2100. The MBMLQ encoder 2100 takes as input the MDCT lines in an MDCT frame or the MDCT lines of the LTP residual if an LTP is present in the system. The MBMLQ employs statistical models of the MDCT lines, and source codes are adapted to signal properties on an MDCT frame-by-frame basis yielding efficient compression to a bitstream.

A local gain of the MDCT lines may be estimated as the RMS value of the MDCT lines, and the MDCT lines normalized in gain normalization module 2120 before input to the MBMLQ encoder 2100. The local gain normalizes the MDCT lines and is a complement to the LP gain normalization. Whereas the LP gain adapts to variations in signal level on a larger time scale, the local gain adapts to variations on a smaller time scale, yielding improved quality of transient sounds and on-sets in speech. The local gain is encoded by fixed rate or variable rate coding and transmitted to the decoder.

A rate control module 2110 may be employed to control the number of bits used to encode an MDCT frame. A rate control index controls the number of bits used. The rate control index points into a list of nominal quantizer step sizes. The table may be sorted with step sizes in descending order.

The MBMLQ encoder is run with a set of different rate control indices, and the rate control index that yields a bit count which is lower than the number of granted bits given by the bit reservoir control is used for the frame. The rate control index varies slowly and this can be exploited to reduce search complexity and to encode the index efficiently. The set of indices that is tested can be reduced if testing is started around the index of the previous MDCT frame. Likewise, efficient entropy coding of the index is obtained if the probabilities peak around the previous value of the index. E.g., for a list of 32 step sizes, the rate control index can be coded using 2 bits per MDCT frame on the average.

FIG. 21 further illustrates schematically the MBMLQ decoder 2150 where the MDCT frame is gain renormalized if a local gain was estimated in the encoder 2100.

Figure 21A:
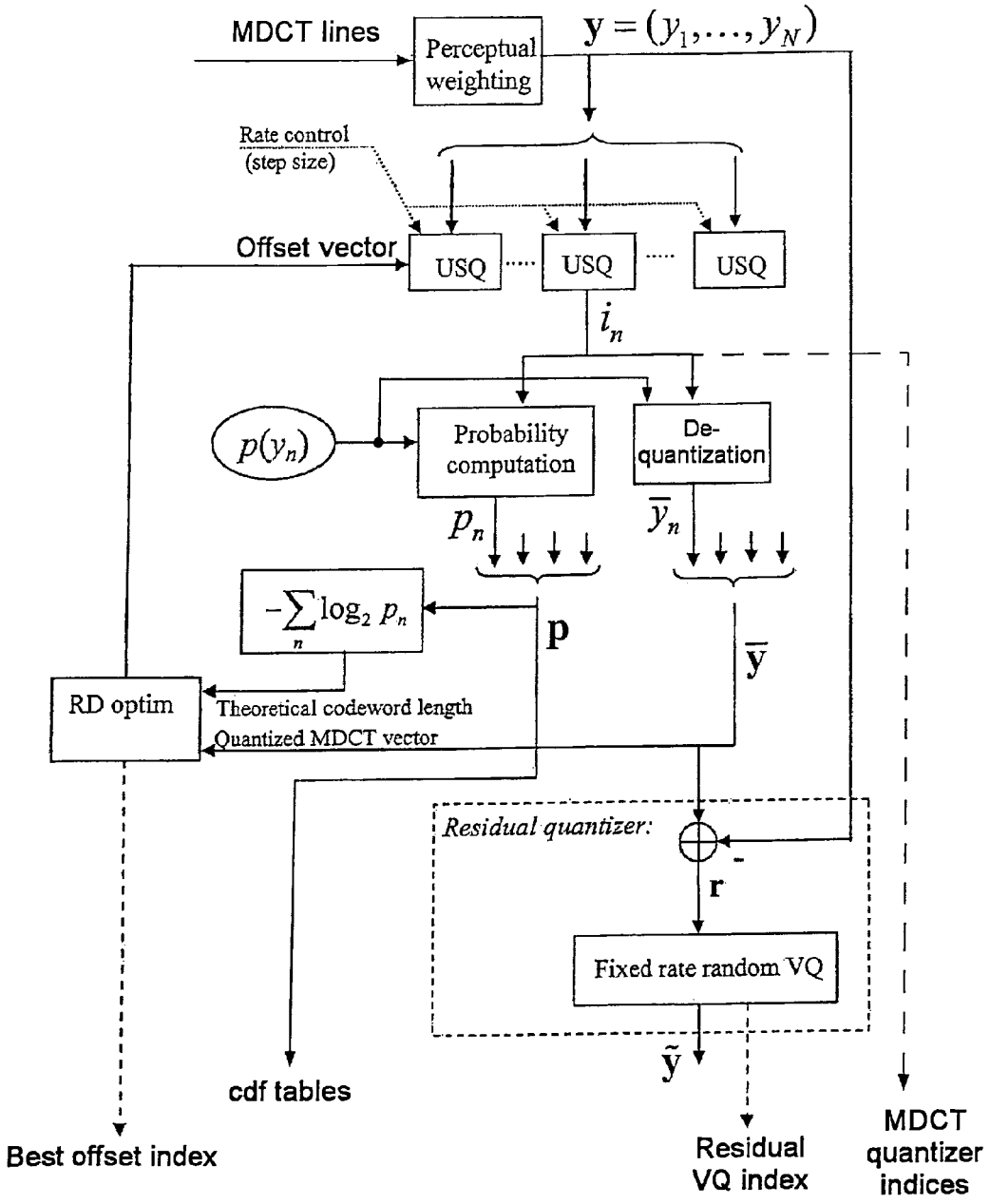
FIG. 21*a* illustrates a another preferred embodiment of a model-based quantizer according to the present invention.

FIG. 21*a* illustrates schematically the model-based entropy constrained encoder 2140 in more detail. The input MDCT lines are perceptually weighed by dividing them with the values of the perceptual masking curve, preferably derived from the LPC polynomial, resulting in the weighted MDCT lines vector $y=(y_1, \ldots, y_N)$. The aim of the subsequent coding is to introduce white quantization noise to the MDCT lines in the perceptual domain. In the decoder, the inverse of the perceptual weighting is applied which results in quantization noise that follows the perceptual masking curve.

Random offsets were discussed previously in the context of the quantizer as means for avoiding spectral holes due to coarse quantization. An additional method for avoiding spectral holes is to incorporate an SBR module 2212 in the LTP loop, as outlined in FIG. 22.

Figure 22:
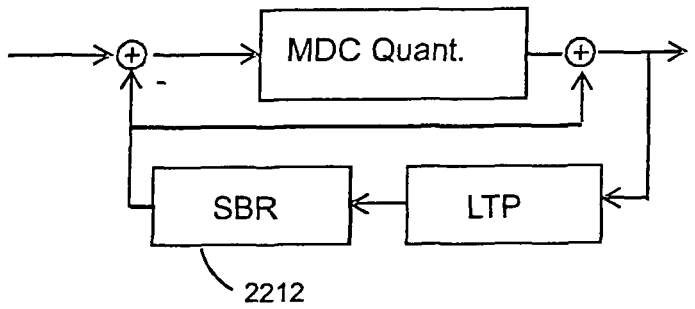
FIG. 22 illustrates a preferred embodiment using an SBR module in the LIP loop according to the present invention.

In FIG. 22 the SBR module 2212 is operating in the MDCT domain, and re-generates high frequencies from lower frequencies. As opposed to a complete encoder/decoder SBR system, the SBR module in the LTP loop does not need any envelope adjustment, since the entire operation is performed in the spectrally flat MDCT domain. The advantage of putting the high frequency reconstruction module in the LTP loop is that the high frequency regenerated signal is subtracted prior to quantization and added after quantization. Hence, if bits are available to code the entire frequency range, the quantizer will encode the signal so that the original high frequencies are retained (since the SBR contribution is subtracted prior to quantization and added after quantization), and if the bit constraints are too sever, the quantizer will not be able to produce energy in the high frequencies, and the SBR regenerated high frequencies is added at the output as a "fall back" thus ensuring energy in the high frequency range.

In one embodiment of the present invention the SBR module in the LTP loop is a simple copy-up (i.e. low frequency lines are copied to high frequency lines) mechanism. In another embodiment a harmonic high frequency regeneration module is used. It should be noted that for harmonic signal, a SBR module that creates a high frequency spectrum that is harmonically related to the low band spectrum is preferred since the high frequencies subtracted from the input signal prior to quantization may coincide well with the original high frequencies and thus reduce the energy of the signal going into the quantizer, thus making it easier to quantize given a certain bit rate requirement. In a third embodiment, the SBR module in the LTP loop can adapt the manner in which it re-creates the high frequencies depending on the transform size and thus, implicitly, the signal characteristics.

The present invention further incorporates a new window sequence coding format. According to an embodiment of the invention, as visualized in FIGS. 23*a, b, c*, the windows used for the MDCT transformation are of dyadic sizes, and may only vary a factor two in size from window to window. Dyadic transform sizes are, e.g., 64, 128, . . . , 2048 samples corresponding to 4, 8, . . . , 128 ms at 16 kHz sampling rate. In general, variable size windows are proposed which can take on a plurality of window sizes between a minimum window size and a maximum size. In a sequence, consecutive window sizes may vary only by a factor of two so that smooth sequences of window sizes without abrupt changes develop. The window sequences as defined by an embodiment, i.e. limited to dyadic sizes and only allowed to vary a factor two in size from window to window, have several advantages.

Firstly, no specific start or stop windows are needed, i.e. windows with sharp edges. This maintains a good time/frequency resolution. Secondly, the window sequence becomes very efficient to code, i.e. to signal to a decoder what particular window sequence is used. According to an embodiment, only one bit is necessary to signal whether the next window in the sequence increases by the factor two or decreases by two. Of course, other coding schemas are possible which efficiently code an entire sequence of window sizes given the above constrains. Finally, the window sequence will always fit nicely into a hyperframe structure.

The hyper-frame structure is useful when operating the coder in a real-world system, where certain decoder configuration parameters need to be transmitted in order to be able to start the decoder. This data is commonly stored in a header field in the bitstream describing the coded audio signal. In order to minimize bitrate, the header is not transmitted for every frame of coded data, particularly in a system as proposed by the present invention, where the MDCT frame-sizes may vary from very short to very large. It is therefore proposed by the present invention to group a certain amount of MDCT frames together into a hyper frame, where the header data is transmitted at the beginning of the hyper frame. The hyper frame is typically defined as a specific length in time. Therefore, care needs to be taken so that the variations of MDCT frame-sizes fits into a constant length, pre-defined hyper frame length. The above outlined inventive window-sequence ensures that the selected window sequence always fits into a hyper-frame structure.

Figure 23A:
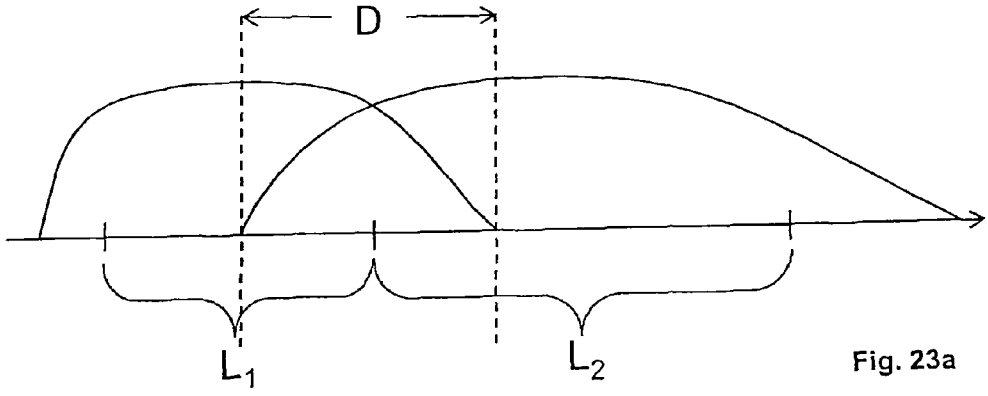
FIG. 23*a* illustrates schematically adjacent windows of an MDCT transform in an embodiment of the present invention.

FIG. 23*a* shows a preferred compatibility requirement for adjacent windows of an MDCT transform, as given by MDCT theory. The left window accommodates a transform size $L_1$ and the right window a transform size $L_2$. The overlap between the windows is supported on a time interval of diameter, or duration, D. For the MDCT transform taught by an embodiment of the present invention, the transform sizes can either be equal, $L_1=L_2$ or differ in size by a factor of two, $L_1=2L_2$ or $L_2=2L_1$. The figure depicts the latter situation. Moreover, as another preferred constraint, the position of the transform size intervals must be obtained by a dyadic partition of a regular equidistant hyperframe sequence. That is, the transform interval positions must result from a succession of splitting intervals in halves, starting from a hyperframe interval. Even when the transform size intervals are given, there is some freedom left in choosing the overlap diameter D. According to an embodiment of the present invention, diameters D very much smaller than the neighboring transform sizes $L_1$, $L_2$ are avoided, since such sharp edges lead to poor frequency resolution of the resulting MDCT transforms.

Figure 23B:
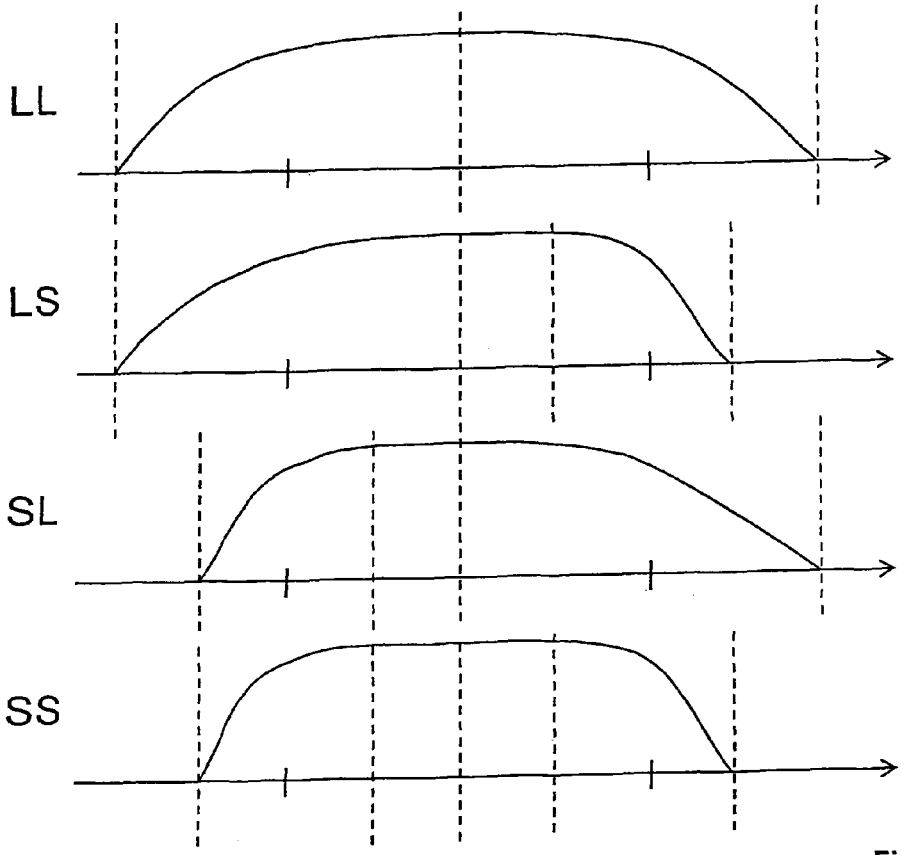
FIG. 23*b* illustrates an embodiment of the present invention using four different MDCT window shapes.

FIG. 23*b* schematically illustrates an embodiment of the present invention using four different MDCT window shapes. The four shapes are denoted by LL: long left and long right overlap;

LS: long left and short right overlap;

SL: short left and long right overlap;

SS: short left and short right overlap.

The MDCT windows used are re-scaled versions of these four window types, where the rescaling is by a factor equal to a power of two. The tick marks on the time axis in FIG. 23*b* denote the transform size intervals, and as it can be seen, the diameter of a long overlap is equal to the transform sizes, whereas the diameter of a short overlap is half the size. In a practical implementation, there is a largest transform size which is $2^N$ times the smallest transform size, with N typically equal to an integer less than 6. Moreover, for the smallest transform size only the LL window may be considered.

Figure 23C:
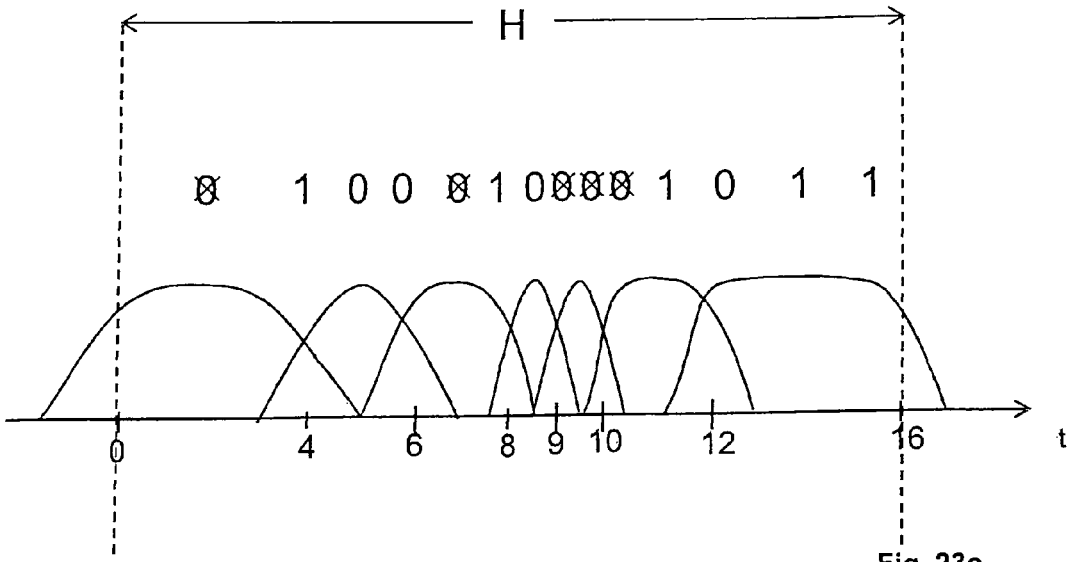
FIG. 23*c* describes an example of the window sequence encoding method according to an embodiment of the present invention.

FIG. 23*c* describes by an example the window sequence encoding method according to an embodiment of the present invention. The scale of the time axis is normalized to units of the smallest transform size. The hyperframe size is 11=16 of that unit, and the left edge of the hyperframe defines the origin t=0 of the time scale. Also it is assumed for simplicity that the largest transform size allowed is $4=2^N$ with N=2. The transform size intervals form a dyadic portion of the hyperframe interval [0,16], consisting of the 7 intervals [0,4], [4,6], [6,8], [8,9], [9,10], [10,12], [12,16] having lengths 4, 2, 2, 1, 1, 2, 4, respectively. As can be seen, these lengths obey the condition of at most changing size by a factor of two between neighbors. All 7 windows are obtained by rescaling of one of the four basic shapes of FIG. 23*b*.

Since transform sizes are kept, doubled, or halved, a first approach to encode those recursively is to keep track of this choice with a terniary symbol along the window sequence. This would however lead to an overcoding of transform sizes and an ambiguous description of window shapes. The former since it is sometimes impossible to double transform size, due to the requirement of using a dyadic partition.

For example, after the interval [4,6] a doubling would result in the interval [6,10] which is not a dyadic subinterval of [0,16]. The latter ambiguous description of window shape holds in the example of FIG. 23*b* since adjacent intervals of equal sizes can share either a long or a short overlap. These overlap requirements are known from the MDCT theory and enable the aliasing cancellation properties of the filterbank.

Instead, the principle of coding according to an embodiment is as follows: For each window, a maximum of 2 bits is defined as follows $b_1$=1, if the transform size is larger than left overlap; 0, otherwise.

$b_2$=1, if right overlap is smaller than the transform size; 0, otherwise.

Stated differently, the mapping from the bit vector ($b_1$, $b_2$) to the window type of FIG. 23*b* is given by

| | $b_2$ | |
|---|---|---|
| $b_1$ | 0 | 1 |
| 0 | LL | LS |
| 1 | SL | SS |

However, if one of the bits can be deduced from either the constraint of dyadic transform intervals or the limits on transform size, then it is not transmitted.

Returning to the specific example of FIG. 23*c*, the left most overlap size of 4 units is an initial state of the current hyperframe obtained by either the final state of the previous hyperframe or by absolute transmission in the case of an independent hyperframe. The first bit to consider is $b_1$ for the leftmost window. Since the length of the interval [0,4] is not larger than 4, the value of this bit is 0. However, since 4 is the largest transform size considered for the example, this first bit is omitted. This is depicted by the crossed out 0 above this first window. Since the right overlap is smaller than the transform size, the second bit for this window is $b_2$=1 as depicted above the overlap point t=4. Next, the interval [4,6] has a size equal to the overlap around t=4 so the first bit for the second window is $b_1$=0. The overlap around t=6 is not smaller than 2 so next bit is 0. The transform size bit $b_1$ for the third window has value 0, but here the option of a longer transform is not consistent with dyadic structure so the bit can be deduced from the situation, hence it is not transmitted and crossed out in the figure. This process continues until the end of the hyperframe is reached at t=16 with the bit 1 for a short overlap. Along the way, the three bits above [9,10] are crossed out on the grounds of no use of overlap for shortest transform size, and wrong position for zoom up. Thus the full uncrossed bit sequence is

01000100001011 but after using information available at both encoder and decoder it is reduced to

100101011 which is 9 bits for coding 7 windows.

It is apparent for those skilled in the art that a further reduction of bit rate can be achieved by entropy coding of these purely descriptive bits.

Figure 24:
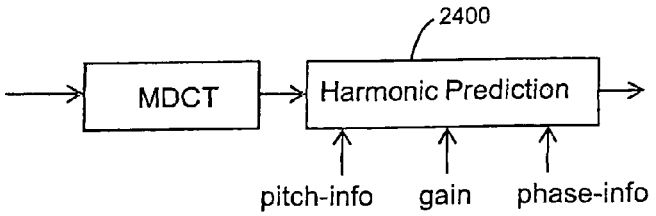
FIG. 24 illustrates a preferred embodiment of harmonic prediction in the MDCT-domain, according to the present invention.

In FIG. 24 an additional feature of the inventive encoder/decoder system is presented. The input signal is input to the MDCT analysis module, and the MDCT representation of the signal is input into a harmonic prediction module 2400. Harmonic prediction is a filtering along the frequency axis, given a parametric filter. Given pitch information, gain information and phase information, the higher (in frequency) MDCT lines can then be predicted from the lower lines, if the input signal contains a harmonic series. Control parameters for the harmonic prediction module are pitch information, gain and phase information.

Figure 25:
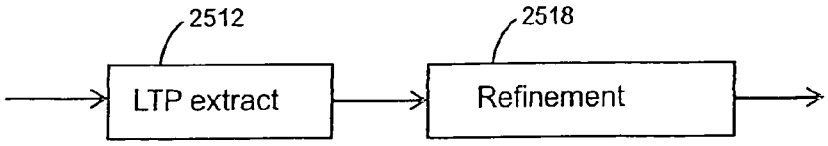
FIG. 25 illustrates the LTP extraction refinement process according to the present invention.

According to an embodiment, virtual LTP vectors in the MDCT-domain are used, as outlined in FIG. 25 which depicts the two modules involved: LTP extraction module 2512 and LIT refinement module 2518. The idea of LTP is that a previous segment of the output signal is used for the decoding of the present segment or frame. Which previous segment to use is decided by the LTP extraction module 2512 given an iterative process minimizing the distortion of the coded signal. When the LIT is performed in the MDCT-domain, the present invention provides a new method of taking into account the overlap of the MDCT frames, i.e. when the LTP lag is chosen so that the segment of the previous output signal that will be MDCT analyzed and used in the decoding process of the current output segment includes, due to the overlap, parts of the present output segment that has not been produced yet.

Figure 25A:
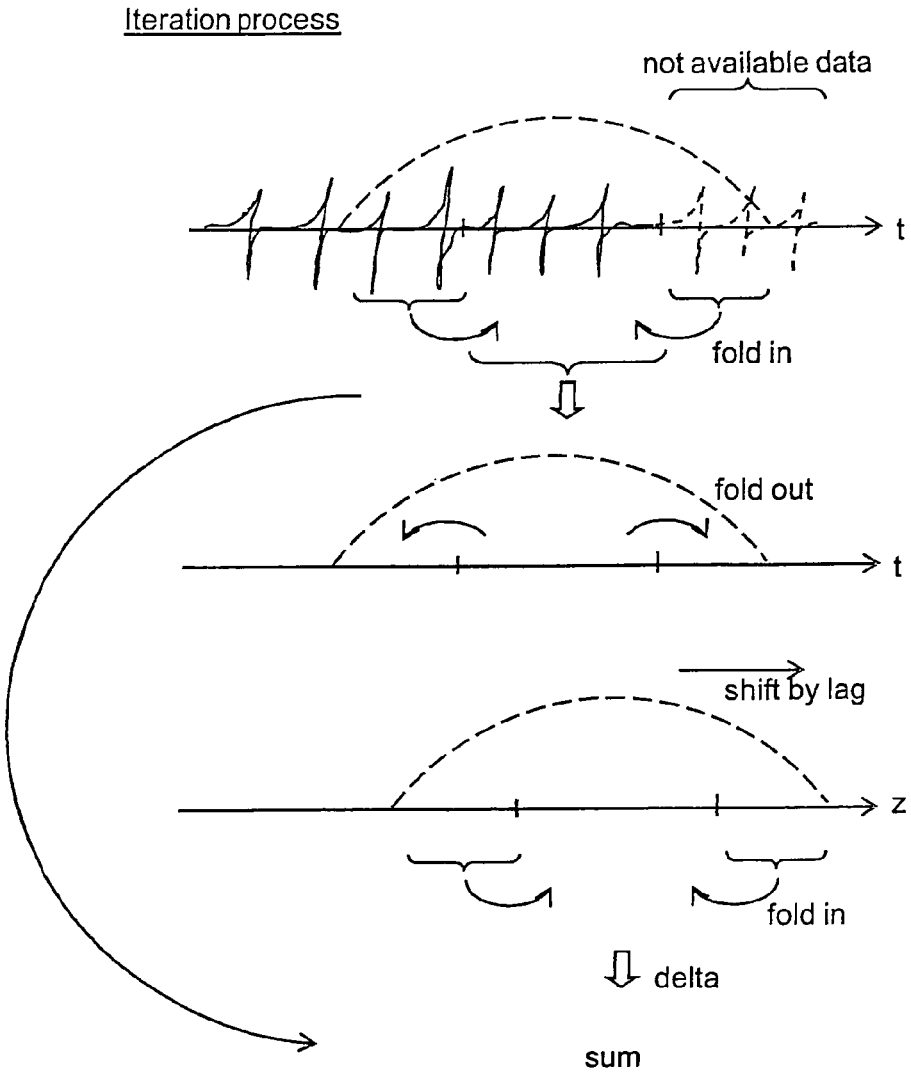
FIG. 25*a* illustrates an MDCT adapted LTP extraction process.

This iterative process is illustrated in the following: From the LTP buffer, a first extraction of a signal is performed by the LTP extraction module 2512. The result of this first extraction is refined by the refinement module 2518, the purpose of which it is to improve the quality of the LTP signal when the chosen lag T is smaller than the duration of the MDCT window of the frame to be coded. The iterative process to refine an LTP contribution for a time lag that is smaller than the analyzed frame is briefly outlined first by referring to FIG. 25*a*. In the first graph, the chosen segment in the LTP buffer is displayed, with the MDCT analysis window superimposed. The right part of the overlap window does not contain available data: the dashed line part of the time-signal. The iterative refinement process goes through the following steps:

1) Fold in the overlap parts as normally done for an MDCT analysis;
2) Fold out the overlap parts (note that the part to the right initially containing no data, now has folded out data);
3) Shift the window to the right by the chosen LTP lag;
4) Fold in the overlapping parts and calculate the delta;
5) Sum the delta with the original LTP segment in the top graph.

This iterative process is preferably done 2 to 4 times.

Figure 25B:
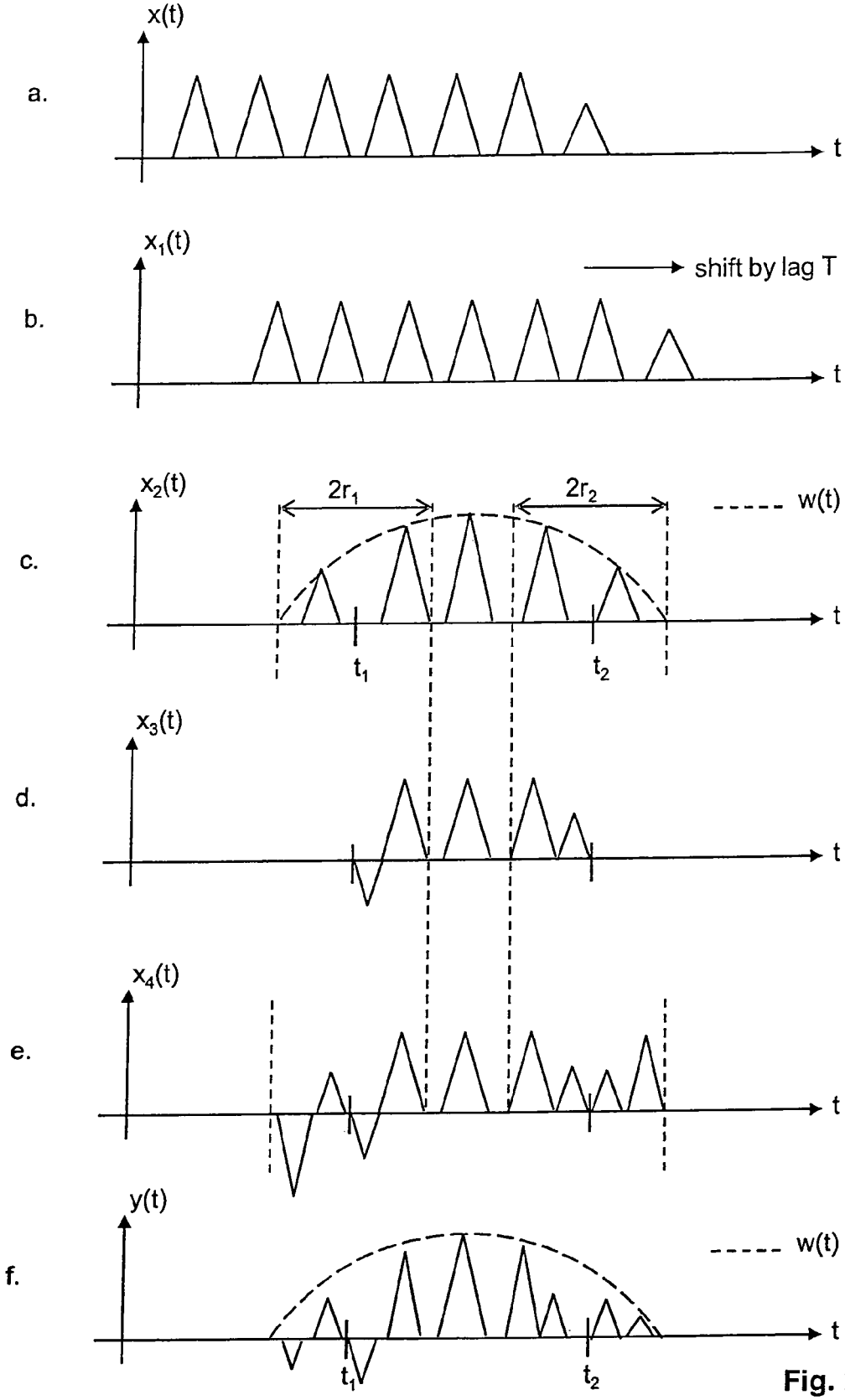
FIG. 25*b* illustrates an iterative refinement of an initial LTP extracted signal.

The MDCT adapted LTP extraction process is depicted in more detail in FIG. 25*b* which shows the steps performed by the LTP extraction module:

a) Depicts a stylized input signal x(t). It is known in a finite time interval only, being the extent of the LTP buffer, or the extent of the current MDCT frame window, or some other interval given by system constraints. However, for the definition of the operations, it is assumed that the input signal is known for all times. This is achieved by setting the signal to zero outside the interval where it is known.

b) The first operation performed on the input signal is to shift it by the LTP lag T. That is, $$x_1(t)=x(t-T).$$

c) The next step is to apply the MDCT window w(t). Such a window consists of a rising part of duration $2r_1$, a falling part of duration $2r_2$, and possibly a constant part in between. The example window is depicted by a dashed graph. The supports of the rising and falling parts of the window are centered around the mirror points $t_1$ and $t_2$ respectively. The signal $x_1(t)$ is multiplied point wise with the window to obtain $$x_2(t)=w(t)\cdot x_1(t).$$

Again, it is assumed that the window w(t) is zero outside the known range $[t_1-r_1, t_2+r_2]$.

Another, but equivalent, view on the operations from x(t) to $x_2(t)$ is to perform the steps $$\text{(i) } \tilde{x}_2(t)=w(t+T)\cdot x(t);$$

$$\text{(ii) } x_2(t)=\tilde{x}_2(t-T);$$

where step (i) amounts to a windowing with a window supported on $(t_1-r_1-T, t_2+r_2-T)$ and step (ii) shifts the result by the LTP lag T.

d) The windowed signal $x_2(t)$ is now folded in to a signal supported on $[t_1, t_2]$ defined by $$x_3(t) = \begin{cases} x_2(t) + \varepsilon_1 x_2(2t_1 - t), & \text{for } t_1 \le t \le t_1 + r_1; \\ x_2(t), & \text{for } t_1 + r_1 < t < t_2 - r_2; \\ x_2(t) + \varepsilon_2 x_2(2t_2 - t), & \text{for } t_2 - r_2 \le t \le t_2. \end{cases}$$

For the depicted example, the values of the signs are $(\epsilon_1, \epsilon_2)=(-1, 1)$ corresponding to a given implementation of the MDCT transform, other possibilities are (1,−1), (1,1) or (−1,−1).

e) The folded in signal $x_3(t)$ is subsequently folded out to a signal supported on the interval $[t_1-r_1, t_2+r_2]$ given by $$x_4(t) = \begin{cases} \varepsilon_1 x_3(2t_1 - t), & \text{for } t_1 - r_1 \le r \le t_1; \\ x_3(t), & \text{for } t_1 < t < t_2; \\ \varepsilon_2 x_3(2t_2 - t), & \text{for } t_2 \le t \le t_2 + r_2. \end{cases}$$

The operations from $x_2(t)$ to $x_4(t)$ can also be combined into one operation of adding or subtracting mirror images of the signal parts on the intervals $[t_1-r_1, t_1+r_1]$ and $[t_2-r_2, t_2+r_2]$.

f) Finally the signal $x_4(t)$ is windowed with the MDCT window to produce the results of the LTP extract operation $$y(t)=w(t)\cdot x_4(t).$$

It is apparent for those skilled in the art that the combined operation from $x_1(t)$ to y(t) is equivalent to an MDCT analysis followed by an MDCT synthesis, and that this realizes an orthogonal projection of the current MDCT frame subspace.

It is important to note that in the case of no overlap, that is $r_1=r_2=0$, nothing happens to $x_2(t)$ due to the operations in d) to f). The windowing then consists of a simple extraction of the signal $x_1(t)$ in the interval $[t_1, t_2]$. In this case the LTP extraction module 2512 performs exactly what a prior art LTP extractor would do.

Figure 25C:
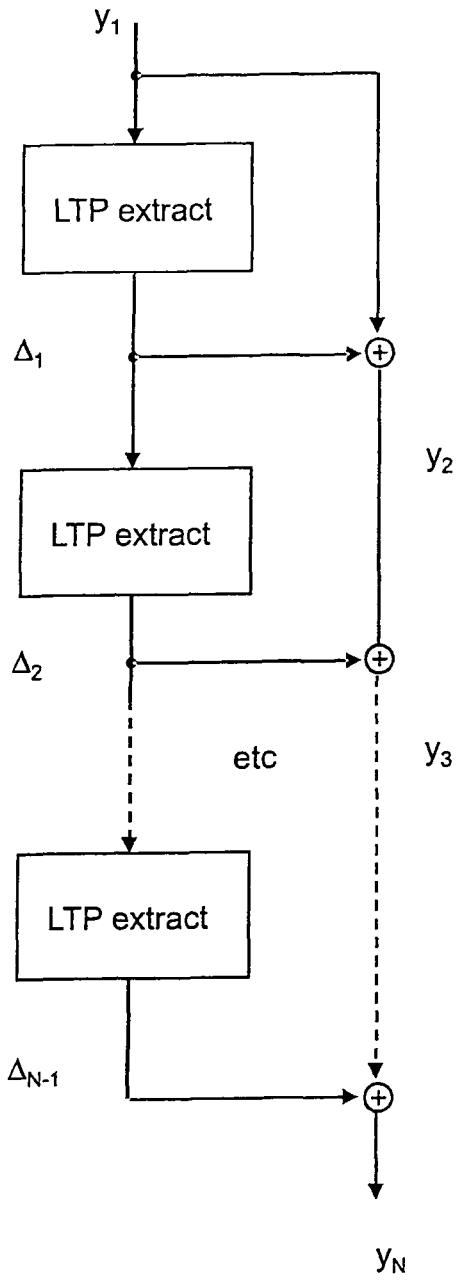
FIG. 25*c* illustrates an alternative implementation of a refinement unit.

FIG. 25*c* illustrates the iterative refinement of an initial LTP extracted signal $y_1(t)$. It consists of applying the LTP extract operation N−1 times, and adding the results to the initial signal. If S denotes the LTP extract operation, the iteration is defined by the formulas $$\Delta_o = y_1;$$

$$\Delta_k = S(\Delta_{k-1}), k=1, \ldots, N-1;$$

$$y_k = y_{k-1} + \Delta_{k-1}, k=2, \ldots N-1.$$

If the LTP lag T>max ($2r_1$, $2r_2$), it can be seen from FIG. 25*b* that there is an N such that $\Delta_N=0$. If $T>r_1+r_2+t_2-t_1$, then already $\Delta_1=0$ and the refinement can be omitted. In practice, a suitable choice of N is in the range from 2 to 4.

In the case of no overlap, that is $r_1=r_2=0$, the method coincides with the virtual vectors creation of prior art methods.

Figure 25D:
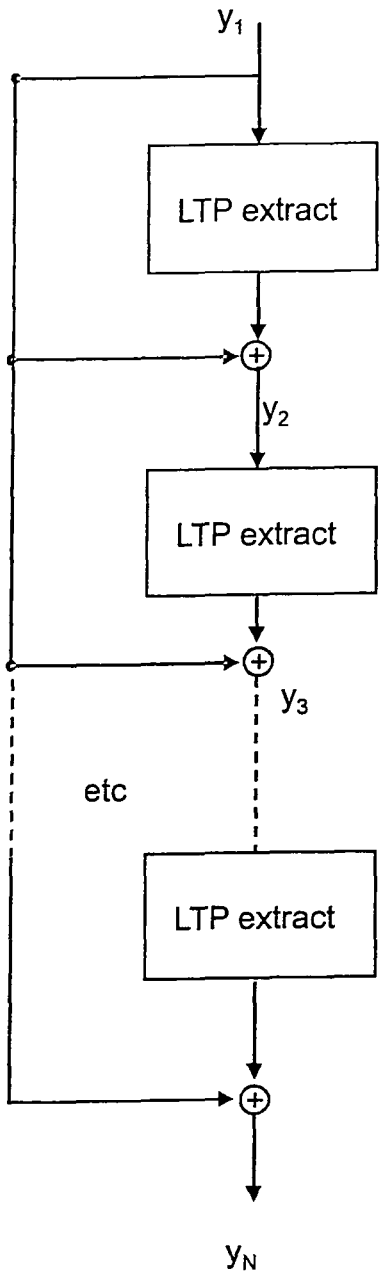
FIG. 25*d* illustrates another alternative implementation of a refinement unit.

FIG. 25*d* shows an alternative implementation of the refinement unit, which performs the iteration $$y_k = y_1 + S(y_{k-1}), k=2 \ldots N.$$

In both implementations the final output from the iteration can be written as $$y_k = \sum_{k=0}^{N-1} S^k y_1 = \sum_{k=1}^{N} S^k x$$

where x is the LTP buffer signal.

According to an embodiment of the present invention, the LTP lag and the LTP gain are coded in a variable rate fashion. This is advantageous since, due to the LTP effectiveness for stationary periodic signals, the LTP lag tends to be the same over somewhat long segments. Hence, this can be exploited by means of arithmetic coding, resulting in a variable rate LTP lag and LTP gain coding.

Similarly, an embodiment of the present invention takes advantage of a bit reservoir and variable rate coding also for the coding of the LP parameters. In addition, recursive LP coding is taught by the present invention.

Figure 26:
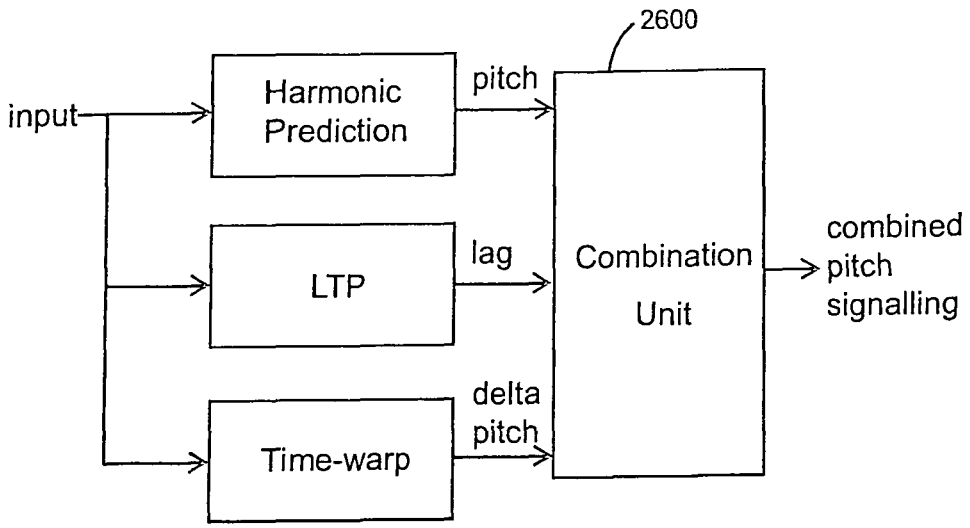
FIG. 26 illustrates a preferred embodiment for combining control data for harmonic prediction, LTP and time-warp, according to the present invention.

As outlined previously, techniques that are designed to improve coding of harmonic signals may be utilized. Such techniques are, e.g., harmonic prediction, LTP, and time-warping. All the aforementioned tools rely implicitly or explicitly on some sort of pitch or pitch-related information. In an embodiment of the present invention, this different information needed by the different techniques may be efficiently coded given that a dependency or correlation exists. This is visualized in FIG. 26 which schematically shows a combination unit 2600 for combining pitch and pitch related parameters such as LTP lag and delta pitch from time-warping, and that produces a combined pitch signaling.

Figure 27:
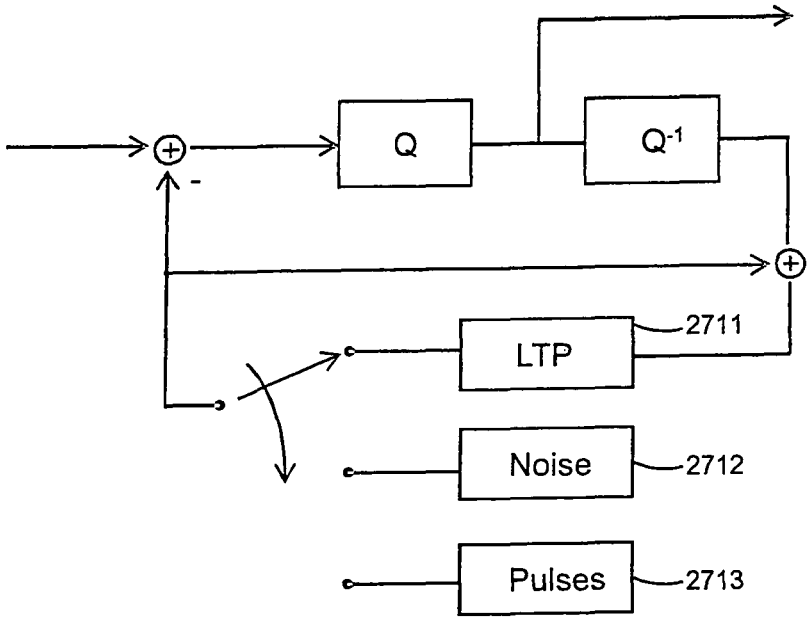
FIG. 27 illustrates a preferred embodiment extending the LTP search with noise and pulse buffers, according to the present invention.

As outlined above, the codec according to an embodiment may utilize a LTP in the MDCT-domain. In order to improve the performance of the LTP in the MDCT-domain, two additional LTP buffers 2512, 2513 may be introduced. As illustrated by FIG. 27, when the LTP extractor searches for the optimal lag in the LTP buffer 2511, a noise vector and a pulse-vector are also included in the search. Noise and pulses may be used as prediction signals, e.g. in transients when the signal of previous segments as stored in the LIT buffer is not suitable. Thus, an enhanced LTP with pulse and noise codebook entries is presented.

Another aspect of the present invention is the handling of a bit reservoir for variable frame sizes in the encoder. A bit reservoir control unit is taught. In addition to a difficulty measure provided as input, the bit reservoir control unit also receives information on the frame length of the current frame. An example of a difficulty measure for usage in the bit reservoir control unit is perceptual entropy, or the logarithm of the power spectrum. Bit reservoir control is important in a system where the frame lengths can vary over a set of different frame lengths. The suggested bit reservoir control unit takes the frame length into account when calculating the number of granted bits for the frame to be coded as will be outlined below.

The bit reservoir is defined here as a certain fixed amount of bits in a buffer that has to be larger than the average number of bits a frame is allowed to use for a given bit rate. If it is of the same size, no variation in the number of bits for a frame would be possible. The bit reservoir control always looks at the level of the bit reservoir before taking out bits that will be granted to the encoding algorithm as allowed number of bits for the actual frame. Thus a full bit reservoir means that the number of bits available in the bit reservoir equals the bit reservoir size. After encoding of the frame, the number of used bits will be subtracted from the buffer and the bit reservoir gets updated by adding the number of bits that represent the constant bit rate. Therefore the bit reservoir is empty, if the number of the bits in the bit reservoir before coding a frame is equal to the number of average bits per frame.

Figure 28A:
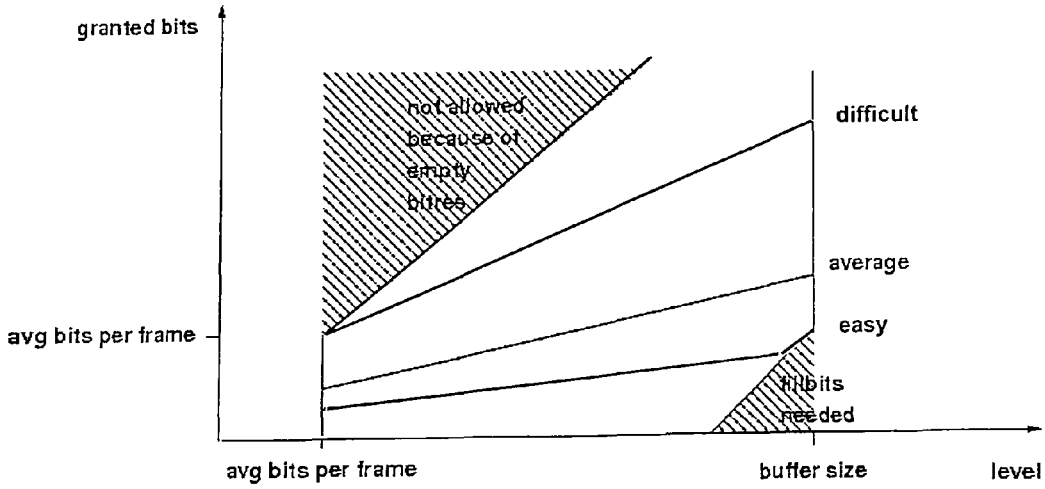
FIG. 28*a* illustrates the basic concept of a bit reservoir control.

In FIG. 28*a* the basic concept of bit reservoir control is depicted. The encoder provides means to calculate how difficult to encode the actual frame compared to the previous frame is. For an average difficulty of 1.0, the number of granted bits depends on the number of bits available in the bit reservoir. According to a given line of control, more bits than corresponding to an average bit rate will be taken out of the bit reservoir if the bit reservoir is quite full. In case of an empty bit reservoir, less bits compared to the average bits will be used for encoding the frame. This behavior yields to an average bit reservoir level for a longer sequence of frames with average difficulty. For frames with a higher difficulty, the line of control may be shifted upwards, having the effect that difficult to encode frames are allowed to use more bits at the same bit reservoir level. Accordingly, for easy to encode frames, the number of bits allowed for a frame will be lower just by shifting down the line of control in FIG. 28*a* from the average difficulty case to the easy difficulty case. Other modifications than simple shifting of the control line are possible, too. For instance, as shown in FIG. 28*a* the slope of the control curve may be changed depending on the frame difficulty.

When calculating the number of granted bits, the limits on the lower end of the bit reservoir have to be obeyed in order not to take out more bits from the buffer than allowed. A bit reservoir control scheme including the calculation of the granted bits by a control line as shown in FIG. 28*a* is only one example of possible bit reservoir level and difficulty measure to granted bits relations. Also other control algorithms will have in common the hard limits at the lower end of the bit reservoir level that prevent a bit reservoir to violate the empty bit reservoir restriction, as well as the limits at the upper end, where the encoder will be forced to write fill bits, if a too low number of bits will be consumed by the encoder.

Figure 28B:
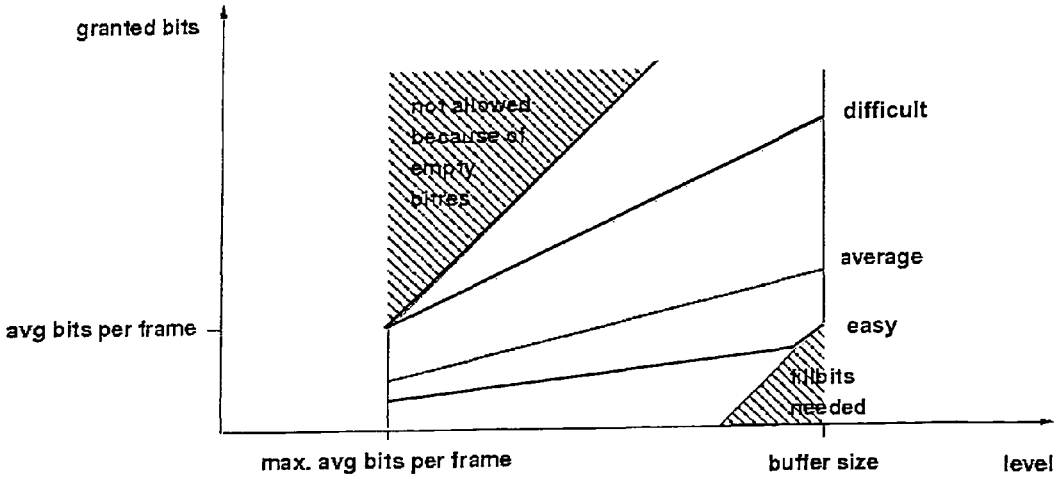
FIG. 28*b* illustrates the concept of a bit reservoir control for variable frame sizes, according to the present invention.

For such a control mechanism being able to handle a set of variable frame sizes, this simple control algorithm has to be adapted. The difficulty measure to be used has to be normalized so that the difficulty values of different frame sizes are comparable. For every frame size, there will be a different allowed range for the granted bits, and because the average number of bits per frame is different for a variable frame size, consequently each frame size has its own control equation with its own limitations. One example is shown in FIG. 28*b*. An important modification to the fixed frame size case is the lower allowed border of the control algorithm. Instead of the average number of bits for the actual frame size, which corresponds to the fixed bit rate case, now the average number of bits for the largest allowed frame size is the lowest allowed value for the bit reservoir level before taking out the bits for the actual frame. This is one of the main differences to the bit reservoir control for fixed frame sizes. This restriction guarantees that a following frame with the largest possible frame size can utilize at least the average number of bits for this frame size.

The difficulty measure may be based, e.g., a perceptual entropy (PE) calculation that is derived from masking thresholds of a psychoacoustic model as it is done in AAC, or as an alternative the bit count of a quantization with fixed step size as it is done in the ECQ part of an encoder according to an embodiment of the present invention. These values may be normalized with respect to the variable frame sizes, which may be accomplished by a simple division by the frame length, and the result will be a PE respectively a bit count per sample. Another normalization step may take place with regard to the average difficulty. For that purpose, a moving average over the past frames can be used, resulting in a difficulty value greater than 1.0 for difficult frames or less than 1.0 for easy frames. In case of a two pass encoder or of a large lookahead, also difficulty values of future frames could be taken into account for this normalization of the difficulty measure.

Figure 29:
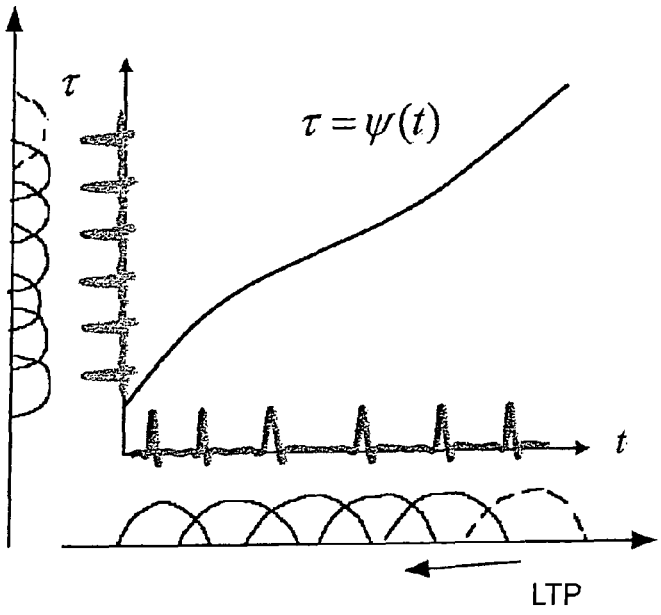
FIG. 29 illustrates the LTP search and application in the context of time-warped MDCT, according to the present invention.

FIG. 29 outlines a warped MDCT-domain as used in an embodiment of the proposed encoder and decoder. As illustrated by the figure, time-warping means resampling the time scale to achieve constant pitch. The x-axis of the figure shows the input signal with varying pitch, and the y-axis of the figure shows the resampled constant pitch signal. The time warping curve may be determined by using a pitch detection algorithm on the present segment, and estimating the pitch evolvement in the segment. The pitch evolvement information is then used to resample the signal in the segment, thus generating the warping curve. As only pitch differences and no absolute pitch information is necessary to determine the pitch evolvement, the algorithm to establish the warping curve is robust against pitch detection errors.

According to an aspect of the present invention, the time-warped MDCT is used in combination with LTP. In this case, the LTP search is done in a constant pitch segment domain in the encoder. This is particular useful for long MDCT frames comprising several pitch pulses which-due to the pitch variation-are not arranged equidistant in the MDCT frame. Thus, a constant pitch segment from the LTP buffer will not fit properly over the plurality of pitch pulses. According to an embodiment, all segments in the LTP buffer are resampled based on the warping curve of the present MDCT frame. Also in the decoder, the selected segment in the LTP buffer is resampled to the warp data of the present frame, given the warp data information. The warp information may be is transmitted to the decoder as part of the bitstream.

Figure 29A:
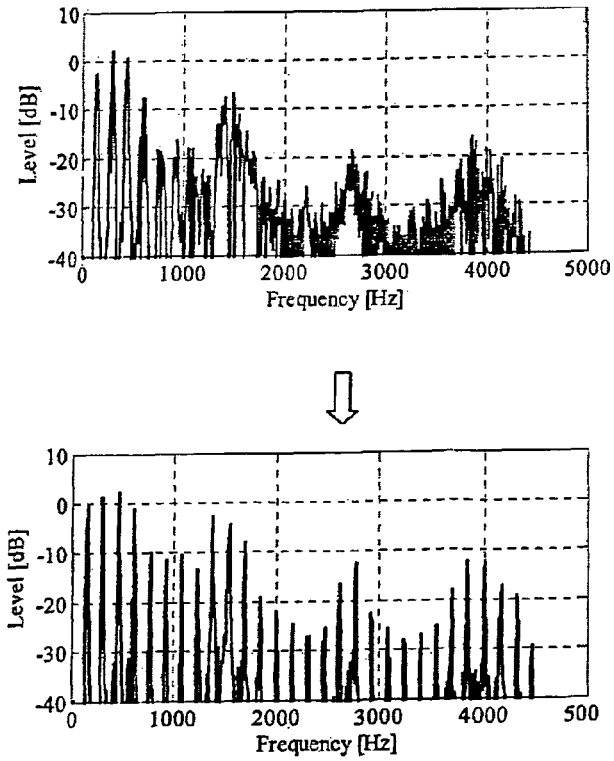
FIG. 29*a* illustrates the effects of time-warped MDCT analysis.

In the top of FIG. 29 windows, i.e. segments in the LTP buffer, are indicated, along with the window of the present, dashed, frame. In FIG. 29*a* the effects of the warped MDCT analysis are visible. To the left is presented the frequency plot of un-warped analysis. Due to a pitch change over the window, the harmonics higher up in frequency do not get properly resolved. In the right part of the figure is the frequency plot of the same signal, albeit analyzed with a time-warped MDCT analysis. Since the pitch is now constant over the analysis window, the higher harmonics are better resolved.

Figure 30:
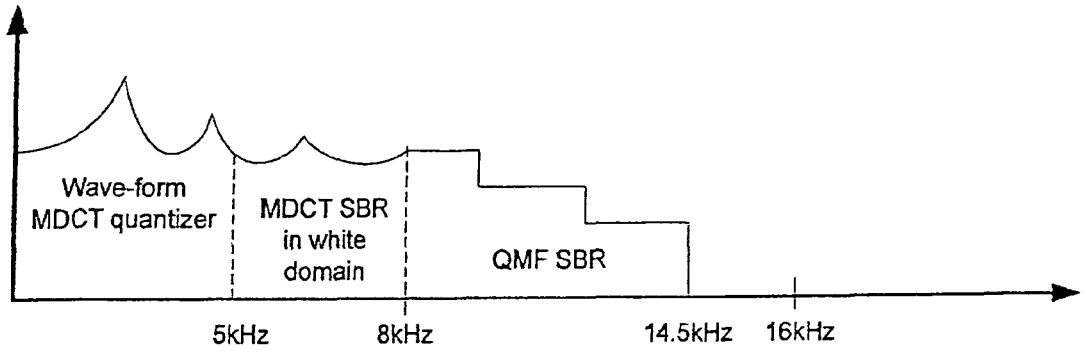
FIG. 30 illustrates a combined SBR in the MDCT and the QMF domain, according to the present invention.

Another layered SBR reconstruction approach according to an embodiment of the present invention is illustrated in FIG. 30. According to FIG. 7, the encoder and decoder can be implemented as a dual rate system where the core coder is sampled at half of the sampling rate, and a high frequency reconstruction module takes care of the higher frequencies, sampled at the original sampling rate. Assuming an original sampling rate of 32 kHz, the LPC filter operates on 16 kHz sampling frequency, providing 8 kHz of whitened signal. The following core coder may however not be able to code 8 kHz of bandwidth given the bit rate constraints imposed. The present invention provides several means to handle this. An embodiment of the invention applies a high frequency reconstruction in the MDCT-domain under the LPC (i.e. based on the LPC filtered signal) to provide the 8 kHz of bandwidth. This is outlined in FIG. 30 where the LPC covers the frequency range from zero to 8 kHz, and the range from 0 to 5 kHz is handled by the MDCT wave-form quantizer. The frequency range from 5 to 8 kHz is handled by an MDCT SBR algorithm, and finally the range from 8 to 16 kHz is handled by a QMF SBR algorithm. The MDCT SBR is based on a similar copy-up mechanism as is used in the QMF based SBR as described above. However, other methods may also advantageously be used, such as adapting the MDCT SBR method as a function of transform size.

In another embodiment of the invention, the upper frequency range of the LP spectrum is quantized and coded dependent on frame size and signal properties. For certain frame sizes and signals, the frequency range is coded according to the above, and for other transform sizes sparse quantization and noise-fill techniques are employed.

While the foregoing has been disclosed with reference to particular embodiments of the present invention, it is to be understood that the inventive concept is not limited to the described embodiments. On the other hand, the disclosure presented in this application will enable a skilled person to understand and carry out the invention. It will be understood by those skilled in the art that various modifications can be made without departing from the spirit and scope of the invention as set out exclusively by the accompanying claims.

The invention claimed is:

1. Audio coding system comprising:

a linear prediction unit for filtering an input signal based on an adaptive filter;

a transformation unit for transforming a frame of the filtered input signal into a transform domain;

a long term prediction unit for determining an estimation of the frame of the filtered input signal based on a reconstruction of a previous segment of the filtered input signal; and a transform domain signal combination unit for combining, in the transform domain, the long term prediction estimation and the transformed input signal to generate a combined transform domain signal, a quantization unit for quantizing the combined transform domain signal;

wherein the long term prediction unit comprises:

a long term prediction extractor for determining a lag value specifying the reconstructed segment of the filtered signal that best fits the current frame of the filtered input signal; and a virtual vector generator to generate an extended segment of the reconstructed signal when the lag value is smaller than a frame length of the transformation unit, wherein the virtual vector generator applies an iterative fold-in fold-out procedure to refine the generated segment of the reconstructed signal, and wherein the audio coding system further comprises a processor coupled to one or more of the linear prediction unit, the transformation unit, the long term prediction unit, the transform domain signal combination unit, or the quantization unit.

2. Audio coding system of claim 1, comprising:

an inverse quantization and inverse transformation unit for generating a time domain reconstruction of the frame of the filtered input signal; and a long term prediction buffer for storing time domain reconstructions of previous frames of the filtered input signal.

3. Audio coding system of claim 1, wherein the adaptive filter for filtering the input signal is based on a Linear Prediction Coding (LPC) analysis operating on a first frame length and producing a whitened input signal, and the transformation applied to the frame of the filtered input signal is a Modified Discrete Cosine Transform (MDCT) operating on a variable second frame length.

4. Audio coding system of claim 3, comprising:

a window sequence control unit for determining, for a block of the input signal, the second frame lengths for overlapping MDCT windows by minimizing a coding cost function for the input signal block.

5. Audio coding system of claim 4, wherein the MDCT window lengths are dyadic partitions of the input signal block.

6. Audio coding system of claim 4, wherein the window sequence control unit is configured to consider long term prediction estimations generated by the long term prediction unit for window length candidates when searching for the sequence of MDCT window lengths that minimizes the coding cost function for the input signal block.

7. Audio coding system of claim 4, comprising a window sequence encoder for jointly encoding MDCT window lengths and window shapes in a sequence.

8. Audio coding system of claim 3, comprising a linear prediction interpolation unit to interpolate linear prediction parameters generated on a rate corresponding to the first frame length so as to match frames of the transform domain signal generated on a rate corresponding to the second frame length.

9. Audio coding system of claim 1, comprising a perceptual modeling unit that modifies a characteristic of the adaptive filter by chirping and/or tilting an LPC polynomial generated by the linear prediction unit for an LPC frame.

10. Audio coding system of claim 1, comprising a time warp unit for uniformly aligning a pitch component in the frame of the filtered signal by resampling the filtered input signal according to a time-warp curve, wherein the transformation unit and the long term prediction unit operate on time-warped signals.

11. Audio coding system of claim 1, comprising a highband encoder for encoding a highband component of the input signal, wherein quantization steps used in the quantization unit when quantizing the transform domain signal are different for encoding components of the transform domain signal belonging to the highband than for components belonging to a lowband of the input signal.

12. Audio coding system of claim 1, comprising:

a frequency splitting unit for splitting the input signal into a lowband component and a highband component; and a highband encoder for encoding the highband component, wherein the lowband component is input to the linear prediction unit.

13. Audio coding system of claim 12, wherein the boundary between the lowband and the highband is variable and the frequency splitting unit determines the cross-over frequency based on input signal properties and/or encoder bandwidth requirements.

14. Audio coding system of claim 12, comprising a signal representation combination unit for combining different signal representations covering the same frequency range and generating signaling data indicating how the signal representations are combined.

15. Audio coding system of claim 1, wherein the long term prediction unit comprises a spectral band replication unit for introducing energy into high frequency components of the long term prediction estimations.

16. Audio coding system of claim 1, comprising a parametric stereo unit for calculating a parametric stereo representation of left and right input channels.

17. Audio coding system of claim 1, wherein the quantization unit decides, based on input signal characteristics, to encode the transform domain signal with a model-based quantizer or a non-model-based quantizer.

18. Audio coding system of claim 1, comprising a quantization step size control unit for determining the quantization step sizes of components of the transform domain signal based on linear prediction and long term prediction parameters.

19. Audio coding system of claim 1, wherein the long term prediction unit comprises:

a long term prediction gain estimator for estimating a gain value applied to the signal of the selected segment of the filtered signal, wherein the lag value and the gain value are determined so as to minimize a distortion criterion.

20. Audio coding system of claim 19, wherein the distortion criterion relates to the difference of the long term prediction estimation to the transformed input signal in a perceptual domain, the distortion criterion being minimized by searching the lag value and the gain value in the perceptual domain.

21. Audio coding system of claim 9, wherein the modified linear prediction polynomial generated by the perceptual modeling unit is applied as MDCT-domain equalization gain curve when minimizing a distortion criterion for determining the lag value.

22. Audio coding system of claim 19, wherein the long term prediction unit comprises a transformation unit for transforming the reconstructed signal of the selected segment into the transform domain.

23. Audio coding system of claim 10, wherein the long term prediction unit resamples the reconstructed filtered input signal based on the time-warp curve received from the time warp unit when the transformation unit is operating on time-warped signals.

24. Audio coding system of claim 1, wherein the long term prediction unit comprises a noise vector buffer and/or a pulse vector buffer.

25. Audio coding system of claim 1, comprising a joint coding unit to jointly encode pitch related information.

26. Audio decoder comprising:

a de-quantization unit for de-quantizing a frame of an input bitstream;

a long term prediction unit for determining long term prediction estimation of the de-quantized frame;

a transform domain signal combination unit for combining, in the transform domain, the long term prediction estimation and the de-quantized frame to generate a combined transform domain signal;

an inverse transformation unit for inversely transforming the combined transform domain signal; and a linear prediction unit for filtering the inversely transformed transform domain signal;

wherein the long term prediction unit comprises:

a long term prediction buffer; and a virtual vector generator to generate an extended segment of a reconstructed signal stored in the long term prediction buffer when a long term prediction lag value is smaller than a length of the frame wherein the virtual vector generator applies an iterative fold-in fold-out procedure to refine the generated segment of the reconstructed signal, and wherein the audio decoder further comprises a processor coupled to one or more of the de-quantization unit, the long term prediction unit, the transform domain signal combination unit, the inverse transformation unit, or the linear prediction unit.

27. Audio decoding method executed by an audio decoding device, comprising the steps:

de-quantizing a frame of an input bitstream;

determining a long term prediction estimation of the de-quantized frame; when the a lag value is smaller than a length of the frame, generating an extended segment of a reconstructed signal that is stored in term prediction buffer; refining the extended segment of the reconstructed signal by applying an iterative fold-in fold-out procedure;

combining, in the transform domain, the long term prediction estimation and the de-quantized frame to generate a combined transform domain signal;

inverse transforming the combined transform domain signal;

filtering the inversely transformed transform domain signal; and outputting a reconstructed audio signal.

28. Computer program stored in a memory device for causing a processor of an audio decoding device to perform the audio decoding method according to claim 27.

29. Audio coding system of claim 25, wherein the pitch related information comprises at least one of long term prediction parameters, harmonic prediction parameters and time-warp parameters.

30. Audio coding system of claim 4, wherein the coding function is a simplistic perceptual entropy.

31. Audio coding system of claim 22, wherein the transformation is a type-IV Discrete-Cosine Transformation.

* * * * *

UNITED STATES PATENT AND TRADEMARK OFFICE

CERTIFICATE OF CORRECTION

PATENT NO. : 8,494,863 B2
APPLICATION NO. : 12/811419
DATED : July 23, 2013
INVENTOR(S) : Arijit Biswas et al.

It is certified that error appears in the above-identified patent and that said Letters Patent is hereby corrected as shown below:

On the title page item (73)-please delete the Assignee

"Dolby Laboratories Licensing Corporation, San Francisco, CA (USA)"

and replace with the correct Assignee name:

--Dolby International AB, Amsterdam Zuidoost, The Netherlands--

Signed and Sealed this
Tenth Day of December, 2013

Margaret A. Focarino

Margaret A. Focarino
*Commissioner for Patents of the United States Patent and Trademark Office*